US009257130B2

(12) United States Patent
Lecomte et al.

(10) Patent No.: US 9,257,130 B2
(45) Date of Patent: Feb. 9, 2016

(54) AUDIO ENCODING/DECODING WITH SYNTAX PORTIONS USING FORWARD ALIASING CANCELLATION

(71) Applicant: Fraunhofer-Gesellschaft zur Foerderung der angewandten Forschung e.V., Munich (DE)

(72) Inventors: Jeremie Lecomte, Fuerth (DE); Patrick Warmbold, Emskirchen (DE); Stefan Bayer, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 299 days.

(21) Appl. No.: 13/736,762

(22) Filed: Jan. 8, 2013

(65) Prior Publication Data

US 2013/0124215 A1 May 16, 2013

Related U.S. Application Data

(63) Continuation of application No. PCT/EP2011/061521, filed on Jul. 7, 2011.

(60) Provisional application No. 61/362,547, filed on Jul. 8, 2010, provisional application No. 61/372,347, filed on Aug. 10, 2010.

(51) Int. Cl.
*G10L 19/04* (2013.01)
*G10L 19/005* (2013.01)
(Continued)

(52) U.S. Cl.
CPC ..... *G10L 19/04* (2013.01); *G10L 19/005* (2013.01); *G10L 19/0212* (2013.01); *G10L 19/20* (2013.01)

(58) Field of Classification Search
CPC ..... G10L 19/18; G10L 19/20; G10L 19/005; G10L 19/0212; G10L 19/04
USPC ..... 704/205, 206, 211, 219, 500, 501, 204
See application file for complete search history.

(56) References Cited

U.S. PATENT DOCUMENTS 7,516,064 B2 4/2009 Vinton et al.
8,457,975 B2 * 6/2013 Neuendorf et al. ..... 704/500
(Continued)

FOREIGN PATENT DOCUMENTS

CN 1926609 5/2007
EP 2373014 10/2011
(Continued)

OTHER PUBLICATIONS

Bessette, Bruno et al., "Alternatives for windowing in USAC", Bruno Bessette et al.: "Alternatives for windowing in USAC", 89. MPEG meeting, Jun. 6, 2009-Mar. 7, 2009, London, No. M16688, Jun. 29, 2009.
(Continued)

*Primary Examiner* — Martin Lerner
(74) *Attorney, Agent, or Firm* — Michael A. Glenn; Perkins Coie LLP

(57) ABSTRACT

A codec supporting switching between time-domain aliasing cancellation transform coding mode and time-domain coding mode is made less liable to frame loss by adding a further syntax portion to the frames, depending on which the parser of the decoder may select between a first action of expecting the current frame to have, and thus reading forward aliasing cancellation data from the current frame and a second action of not-expecting the current frame to have, and thus not reading forward aliasing cancellation data from the current frame. In other words, while a bit of coding efficiency is lost due to the provision of the new syntax portion, it is merely the new syntax portion which provides for the ability to use the codec in case of a communication channel with frame loss. Without the new syntax portion, the decoder would not be capable of decoding any data stream portion after a loss and will crash in trying to resume parsing. Thus, in an error prone environment, the coding efficiency is prevented from vanishing by the introduction of the new syntax portion.

20 Claims, 23 Drawing Sheets

(51) Int. Cl.
*G10L 19/20* (2013.01)
*G10L 19/02* (2013.01)

(56) References Cited

U.S. PATENT DOCUMENTS

| | | | | |
|---|---|---|---|---|
| 8,706,480 | B2 * | 4/2014 | Herre et al. | 704/221 |
| 8,898,059 | B2 * | 11/2014 | Beack et al. | 704/219 |
| 8,918,324 | B2 * | 12/2014 | Choo | G10L 19/12 704/201 |
| 8,959,015 | B2 * | 2/2015 | Lee | G10L 19/20 704/200 |
| 8,959,017 | B2 * | 2/2015 | Grill | G10L 19/173 704/201 |
| 9,043,215 | B2 * | 5/2015 | Neuendorf | G10L 19/008 704/500 |
| 2003/0009325 | A1 * | 1/2003 | Kirchherr | G10L 19/20 704/211 |
| 2005/0192797 | A1 * | 9/2005 | Makinen | 704/219 |
| 2005/0192798 | A1 * | 9/2005 | Vainio et al. | 704/223 |
| 2007/0168197 | A1 | 7/2007 | Vasilache | |
| 2007/0269063 | A1 | 11/2007 | Goodwin et al. | |
| 2008/0052066 | A1 | 2/2008 | Oshikiri et al. | |
| 2009/0299757 | A1 | 12/2009 | Guo et al. | |
| 2010/0063806 | A1 * | 3/2010 | Gao | 704/207 |
| 2010/0138218 | A1 | 6/2010 | Geiger | |
| 2010/0145688 | A1 * | 6/2010 | Sung | G10L 19/20 704/208 |
| 2010/0217607 | A1 * | 8/2010 | Neuendorf et al. | 704/500 |
| 2010/0262420 | A1 | 10/2010 | Herre et al. | |
| 2010/0324912 | A1 * | 12/2010 | Choo | H03M 7/4006 704/500 |
| 2011/0087494 | A1 * | 4/2011 | Kim | G10L 19/0212 704/500 |
| 2011/0119054 | A1 * | 5/2011 | Lee | G10L 19/20 704/203 |
| 2011/0153333 | A1 * | 6/2011 | Bessette | 704/500 |
| 2011/0178809 | A1 * | 7/2011 | Philippe et al. | 704/500 |
| 2012/0022880 | A1 * | 1/2012 | Bessette | G10L 19/0212 704/503 |
| 2012/0209600 | A1 * | 8/2012 | Kim et al. | 704/219 |
| 2012/0226496 | A1 * | 9/2012 | Yoon et al. | 704/219 |
| 2013/0090929 | A1 * | 4/2013 | Ishikawa et al. | 704/262 |

FOREIGN PATENT DOCUMENTS

| | | | |
|---|---|---|---|
| JP | 2009-523258 | | 1/2009 |
| KR | 10-2010-0059726 | | 6/2010 |
| TW | 200841743 | | 12/1996 |
| TW | 200912896 | | 6/1997 |
| WO | 2010125228 | A1 | 11/2010 |
| WO | WO-2010/003532 | | 2/2011 |
| WO | WO-2010/003563 | | 2/2011 |

OTHER PUBLICATIONS

Geiser, Bernd et al., "Candidate proposal for ITU-T super-wideband speech and audio coding", Bernd Geiser et al.: "Candidate proposal for ITU-T super-wideband speech and audio coding", Acoustics, Speech and signal processing, 2009, ICASSP 2009, IEEE international conference on, IEEE, Piscatway, NJ, USA, Apr. 19, 2009, pp. 4121-4124, Apr. 19, 2009, 4121-4124.

Geiser, Bernd et al., "Joint pre-echo control and frame erasure concealment for VOIP audio codes", Bernd Geiser et al: "Joint pre-echo control and frame erasure concealment for VOIP audio codes", 17th European signal processing conference (Eusipco 2009), Aug. 24, 2009, pp. 1259-1263, Aug. 24, 2009, 1259-1263.

Neuendorf, Max et al., "Completion of core experiment on unification of USAC windowing and frame transitions", Max Neuendorf et al: "Completion of core experiment on unification of USAC windowing and frame transitions", 91. MPEG meeting, Jan. 18, 2010-Jan. 22, 2010, Kyoto, No. M17167, Jan. 16, 2010.

Anonymous, "Call for Proposals on Unified Speech and Audio Goding", 82. MPEG Meeting; Oct. 22-26, 2007; Shenzhen; (Motion Pictureexpert Group or ISO/IEC JTC1/SC29/WG11), No. N9519, XP030016014, ISSN: 0000-0044, Oct. 26, 2007, (6 pages).

Anonymous, "ISO Guidlines and Poicies for the protection of ISO's intellectual property", Retrieved from the Internet: URL:http://www.open-std.org/jtc1/impit/open/j1n4564.htm [retrieved on Nov. 11, 2015], Jan. 17, 1997 (20 pages).

Anonymous, "WD5 of USAC", 90. MPEG Meeting; Oct. 26-30, 2009; Xian; (Motion Picture Expertgroup or ISO/IEC JTC1/SC29/WG11), No. N11040, XP030017537, ISSN: 0000-0031, Dec. 8, 2009 (146 pages).

* cited by examiner

| Syntax | No. of bits | Mnemonic |
|---|---|---|
| single_channel_element() | | |
| { | | |
| core_mode ← 230 | 1 | uimsbf |
| fac_data_present ← 199 | 1 | uimsbf |
| if (core_mode==1) { | | |
| lpd_channel_stream(core_mode_last, fac_data_present); | | |
| } | | |
| else { | | |
| fd_channel_stream(0,0,noiseFilling,core_mode_last, fac_data_present); | | |
| } | | |
| } | | |

FIG 15

| Syntax | No. of bits | Mnemonic |
|---|---|---|
| channel_pair_element() | | |
| { | | |
| core_mode0 (232) | 1 | uimsbf |
| core_mode1 | 1 | uimsbf |
| fac_data_present0 (199) | 1 | uimsbf |
| fac_data_present1 (199) | 1 | uimsbf |
| if (core_mode0==0&&core_mode1==0){ | | |
| common_window; | 1 | uimsbf |
| if (common_window) { | | |
| ics_info(); | | |
| ms_mask_present; | 2 | uimsbf |
| if (ms_mask_present==1){ | | |
| for (g=0;g<num_window_groups;g++){ | | |
| for(sfb=0;sfb<max_sfb;sfb++){ | | |
| ms_used[g][sfb]; | 1 | uimsbf |
| } | | |
| } | | |
| } | | |
| } | | |
| if (tw_mdct) { | | |
| common_tw; | 1 | uimsbf |
| if (common_tw){ | | |
| tw_data(); | | |
| } | | |
| } | | |
| } | | |
| else{ | | |
| common_window=0; | | |
| common_tw=0; | | |
| } | | |
| if (core_mode0==1){ | | |
| lpd_channel_stream(core_mode0_last, fac_data_present0); | | |
| } | | |

FIG 16A

| FIG 16A | FIG 16 |
|---|---|
| FIG 16B | |

```
  else{
      fd_channel_stream(common_window, common_tw_ noiseFilling,
                        core_mode0_last,fac_data_present0);
     }

    if (core_mode1==1) {
       lpd_channel_stream(core_mode1_last, fac_data_present1);
    }
    else{
       fd_channel_stream(common_window, common_tw, noiseFilling,
                         core_mode1_last, fac_data_present1);
    }
}
```

FIG 16B

| FIG 16A | FIG 16 |
|---|---|
| FIG 16B | |

| Syntax | No. of bits | Mnemonic |
|---|---|---|
| Lpd_channel_stream(core_mode_last, fac_data_present) | | |
| { | | |
| ~~Prev_frame_was_lpd~~ ← 200 | ~~1~~ | ~~uimsbf~~ |
| **Acelp_core_mode** | **3** | **uimsbf** |
| **Lpd_mode** ← 214 | **5** | **uimsbf,** Note 1 |
| First_tcx_flag=TRUE; | | |
| K=0; | | |
| if (first_lpd_flag\|\|(prev_frame_was_lpd==0)){last_lpd_mode=-1} | | Note 2 |
| While (k<4){ | | |
| if (k==0){ | | |
| if ((prev_frame_was_lpd==1)&&(fac_data_present==1)){ | | |
| 206 → fac_data(0); | | |
| } | | |
| }else{ | | |
| if((last_lpd_mode==0&&mod[k]>0)\|\| | | |
| (last_lpd_mode>0&&mod[k]==0)){ | | |
| 216 → fac_data(0); | | |
| } | | |
| } | | |

FIG 17A | FIG 17B | FIG 17

FIG 17A

```
        If(mod[k]==0){
            Acelp_coding(acelp_core_mode);
208         last_lpd_mode=0;
            k+=1;
        }
        else{
            tcx_coding(lg(mod[k]), first_tcx_flag);                    Note 3
210         last_lpd_mode=mod[k]
            k+=(1<<(mod[k]-1));
            first_tcx_flag=FALSE;
        }
    }

    lpc_data(first_lpd_flag)  212
220
    if(prev_frame_was_lpd==0&&mod[0]==0)  {
        fac_data(1)  202
    }
}
```

FIG 17B

| FIG 17A | FIG 17 |
|---|---|
| FIG 17B | |

Syntax of fac_data()

| Syntax | No. of bits | Mnemonic |
|---|---|---|
| fac_data(useGain) | | |
| { | | |
| if(useGain) { | | |
| **fac_gain** ← 204 | **7** | **uimsbf** |
| } | | |
| for (i=0;i<fac_length/8;i++){ | | |
| **nq**[i] | **1..n** | **vlclbf,** Note 1 |
| **FAC**[i] | **4*nq**[i] | **uimsbf** |
| } | | |
| } | | |

Note 1: This value is encoded using a modified unary code, where qn=0 is represented by one "0" bit, and any value qn greater or equal to 2 is represented by qn-1 "1" bits followed by one "0" stop bit. Note that qn=1 cannot be signaled, because the codebook $Q_1$ is not defined

FIG 18

Syntax of fd_channel_stream()

| Syntax | No. of bits | Mnemonic |
|---|---|---|
| fd_channel_stream(common_window, common_tw, noiseFilling, core_mode_last, fac_data_present) | | |
| { | | |
| **global_gain;** | **8** | **uimsbf** |
| if (noiseFilling){ | | |
| **noise_level;** | **3** | **uimsbf** |
| **noise_offset** | **5** | **uimsbf** |
| } | | |
| else { | | |
| noise_level=0 | | |
| } | | |
| if (!common_window){ | | |
| ics_info(); | | |
| } | | |
| if(tw_mdct){ | | |
| if(!common_tw){ | | |
| tw_data(); | | |
| } | | |
| } | | |

FIG 19A

| FIG 19A | FIG 19 |
|---|---|
| FIG 19B | |

```
scale_factor_data();
tns_data_present;                    1    uimsbf
if (tns_data_present){
        tns_data();
}
ac_spectral_data();

if (fac_data_present){
        fac_data(1)
}
}
```

218

FIG 19B

| FIG 19A | FIG 19 |
|---|---|
| FIG 19B | |

Syntax of fd_channel_stream()

| Syntax | No. of bits | Mnemonic |
|---|---|---|
| fd_channel_stream(common_window, common_tw, tns_data_present, noiseFilling, indepFlag) | | |
| { | | |
| **global_gain;** | **8** | **uimsbf** |
| if (noiseFilling){ | | |
| **noise_level;** | **3** | **uimsbf** |
| **noise_offset;** | **5** | **uimsbf** |
| } | | |
| else { | | |
| noise_level=0; | | |
| } | | |
| if (!common_window){ | | |
| ics_info(); | | |
| } | | |
| if(tw_mdct){ | | |
| if(!common_tw){ | | |
| tw_data(); | | |
| } | | |
| } | | |

FIG 20A

| FIG 20A | FIG 20 |
|---|---|
| FIG 20B | |

```
scale_factor_data();
if (tns_data_present){
    tns_data();
}
ac_spectral_data(indepFlag);

fac_data_present          1          uimsbf
if (fac_data_present){
    fac_length=(window_sequence==EIGHT_SHORT_SEQUENCE)? ccfl/16:ccfl/8;
    fac_data(1,fac_length);
}
}
```

199

218

FIG 20B

| FIG 20A | FIG 20 |
|---|---|
| FIG 20B | |

Syntax of lpd_channel_stream()

| Syntax | No. of bits | Mnemonic |
|---|---|---|
| lpd_channel_stream(indepFlag) | | |
| { | | |
| **acelp_core_mode;** | **3** | **uimsbf** |
| **lpd_mode;** ← 214 | **5** | **uimsbf,** Note 1 |
| **bpf_control_info** | **1** | **uimsbf** |
| **core_mode_last;** ← 200 | **1** | **uimsbf** |
| **fac_data_present;** ← 199 | **1** | **uimsbf** |
| first_lpd_flag=!core_mode_last; | | |
| first_tcx_flag=TRUE; | | |
| k=0; | | |
| if (first_lpd_flag) {last_lpd_mode=-1;} | | |
| while (k<4){ | | |
| if(k==0){ | | |
| if((core_mode_last==1)&&(fac_data_present==1)) { | | |
| 206 → fac_data(0,ccfl/8); | | |
| } | | |
| } else { | | |
| if( (last_lpd_mode==0&&mod[k]>0\|\| | | |
| (last_lpd_mode>0&&mod[k]==0)){ | | |
| 216 → fac_data(0,ccfl/8); | | |
| } | | |
| } | | |
| if (mode[k]==0){ | | |
| 208 → acelp_coding(acelp_core_mode); | | |
| last_lpd_mode=0; | | |
| k+=1; | | |

| FIG 21A | FIG 21 |
|---|---|
| FIG 21B | |

FIG 21A

```
        }
        else{
          tcx_coding(lg(mod[k]), first_tcx_flag, indepFlag);
210       last_lpd_mode=mod[k];
          k+=(1<<(mod[k]-1));
          first_tcx_flag=FALSE;

      }
    }

    lpc_data(first_lpd_flag); ←212

    if((core_mode_last==0)&&(fac_data_present==1)){
      short_fac_flag;                                   1        uimsbf
220   fac_length=short_fac_flag ? ccfl/16:ccfl/8;
      fac_data(1,fac_length); ←202
    }
}
```

Note 1: lpd_mode defines the contents of the array mod[]

| FIG 21A | FIG 21 |
|---|---|
| FIG 21B | |

FIG 21B

Syntax of fac_data()

| Syntax | No. of bits | Mnemonic |
|---|---|---|
| fac_data(useGain, fac_length) | | |
| { | | |
| if(useGain) { | | |
| **fac_gain;** ← 204 | **7** | **uimsbf** |
| } | | |
| for (i=0;i<fac_length/8;i++){ | | |
| code_book_indices (i,1,1); | | |
| } | | |
| } | | |

FIG 22

AUDIO ENCODING/DECODING WITH SYNTAX PORTIONS USING FORWARD ALIASING CANCELLATION

CROSS-REFERENCE TO RELATED APPLICATIONS

This application is a continuation of copending International Application No. PCT/EP2011/061521, filed Jul. 7, 2011, which is incorporated herein by reference in its entirety, and additionally claims priority from U.S. Patent Application No. 61/362,547, filed Jul. 8, 2010 and U.S. Patent Application No. 61/372,347, filed Aug. 10, 2010, all of which are incorporated herein by reference in their entirety.

BACKGROUND OF THE INVENTION

The present invention is concerned with a codec supporting a time-domain aliasing cancellation transform coding mode and a time-domain coding mode as well as forward aliasing cancellation for switching between both modes.

It is favorable to mix different coding modes in order to code general audio signals representing a mix of audio signals of different types such as speech, music or the like. The individual coding modes may be adapted for particular audio types, and thus, a multi-mode audio encoder may take advantage of changing the encoding mode over time corresponding to the change of the audio content type. In other words, the multi-mode audio encoder may decide, for example, to encode portions of the audio signal having speech content, using a coding mode especially dedicated for coding speech, and to use another coding mode in order encode different portions of the audio content representing non-speech content such as music. Time-domain coding modes such as codebook excitation linear prediction coding modes, tend to be more suitable for coding speech contents, whereas transform coding modes tend to outperform time-domain coding modes as far as the coding of music is concerned, for example.

There have already been solutions for addressing the problem of coping with the coexistence of different audio types within one audio signal. The currently emerging USAC, for example, suggests switching between a frequency domain coding mode largely complying with the AAC standard, and two further linear prediction modes similar to sub-frame modes of the AMR-WB plus standard, namely a MDCT (Modified Discrete Cosine Transformation) based variant of the TCX (TCX=transform coded excitation) mode and an ACELP (adaptive codebook excitation linear prediction) mode. To be more precise, in the AMR-WB+ standard, TCX is based on a DFT transform, but in USAC TCX has a MDCT transform base. A certain framing structure is used in order to switch between FD coding domain similar to AAC and the linear prediction domain similar to AMR-WB+. The AMR-WB+ standard itself uses an own framing structure forming a sub-framing structure relative to the USAC standard. The AMR-WB+ standard allows for a certain sub-division configuration sub-dividing the AMR-WB+ frames into smaller TCX and/or ACELP frames. Similarly, the AAC standard uses a basis framing structure, but allows for the use of different window lengths in order to transform code the frame content. For example, either a long window and an associated long transform length may be used, or eight short windows with associated transformations of shorter length.

MDCT causes aliasing. This is, thus, true, at TCX and FD frame boundaries. In other words, just as any frequency domain coder using MDCT, aliasing occurs at the window overlap regions, that is cancelled by the help of the neighbouring frames. That is, for any transitions between two FD frames or between two TCX (MDCT) frames or transition between either FD to TCX or TCX to FD, there is an implicit aliasing cancellation by the overlap/add procedure within the reconstruction at the decoding side. Then, there is no more aliasing after the overlap add. However, in case of transitions with ACELP, there is no inherent aliasing cancellation. Then, a new tool has to be introduced which may be called FAC (forward aliasing cancellation). FAC is to cancel the aliasing coming from the neighbouring frames if they are different from ACELP.

In other words, aliasing cancellation problems occur whenever transitions between transform coding mode and time domain coding mode, such as ACELP, occur. In order to perform the transformation from the time domain to the spectral domain as effective as possible. time-domain aliasing cancellation transform coding is used, such as MDCT, i.e. a coding mode using a overlapped transform where overlapping windowed portions of a signal are transformed using a transform according to which the number of transform coefficients per portion is less than the number of samples per portion so that aliasing occurs as far as the individual portions are concerned, with this aliasing being cancelled by time-domain aliasing cancellation, i.e. by adding the overlapping aliasing portions of neighboring re-transformed signal portions. MDCT is such a time-domain aliasing cancellation transform. Disadvantageously, the TDAC (time-domain aliasing cancellation) is not available at transitions between the transform coding (TC) coding mode and the time-domain coding mode.

In order to solve this problem, forward aliasing cancellation (FAC) may be used according to which the encoder signals within the data stream additional FAC data within a current frame whenever a change in the coding mode from transform coding to time-domain coding occurs. This, however, necessitates the decoder to compare the coding modes of consecutive frames in order to ascertain as to whether the currently decoded frame comprises FAC data within its syntax or not. This, in turn, means that there may be frames for which the decoder may not be sure as to whether the decoder has to read or parse FAC data from the current frame or not. In other words, in case that one or more frames were lost during transmission, the decoder does not know for the immediately succeeding (received) frames as to whether a coding mode change occurred or not, and as to whether the bit stream of the current frame encoded data contains FAC data or not. Accordingly, the decoder has to discard the current frame and wait for the next frame. Alternatively, the decoder may parse the current frame by performing two decoding trials, one assuming that FAC data is present, and another assuming that FAC data is not present, with subsequently deciding as to whether one of both alternatives fails. The decoding process would most likely make the decoder crash in one of the two conditions. That is, in reality, the latter possibility is not a feasible approach. The decoder should at any time know how to interpret the data and not rely on its own speculation on how to treat the data.

SUMMARY

According to an embodiment, a decoder for decoding a data stream having a sequence of frames into which time segments of an information signal are coded, respectively, may have a parser configured to parse the data stream, wherein the parser is configured to, in parsing the data stream, read a first syntax portion and a second syntax portion from a current frame; and a reconstructor configured to reconstruct a current time segment of the information signal associated with the current frame based on information acquired from the current frame by the parsing, using a first selected one of a Time-Domain Aliasing Cancellation transform decoding mode and a time-domain decoding mode, the first selection depending on the first syntax portion, wherein the parser is configured to, in parsing the data stream, perform a second selected one of a first action of expecting the current frame to have, and thus reading forward aliasing cancellation data from the current frame and a second action of not-expecting the current frame to have, and thus not reading forward aliasing cancellation data from the current frame, the second selection depending on the second syntax portion, wherein the reconstructor is configured to perform forward aliasing cancellation at a boundary between the current time segment and a previous time segment of a previous frame using the forward aliasing cancellation data.

According to another embodiment, an encoder for encoding an information signal into data stream such that the data stream has a sequence of frames into which time segments of the information signal are coded, respectively, may have a constructor configured to code a current time segment of the information signal into information of the current frame using a first selected one of a Time-Domain Aliasing Cancellation transform coding mode and a time-domain coding mode; and an inserter configured to insert the information into the current frame along with a first syntax portion and a second syntax portion, wherein the first syntax portion signals the first selection, wherein the constructor and inserter are configured to determine forward aliasing cancellation data for forward aliasing cancellation at a boundary between the current time segment and a previous time segment of a previous frame and insert the forward aliasing cancellation data into the current frame in case the current frame and the previous frame are encoded using different ones of the Time-Domain Aliasing Cancellation transform coding mode and the time-domain coding mode, and refraining from inserting any forward aliasing cancellation data into the current frame in case the current frame and the previous frame are encoded using equal ones of the Time-Domain Aliasing Cancellation transform coding mode and the time-domain coding mode, wherein the second syntax portion is set depending on as to whether the current frame and the previous frame are encoded using equal or different ones of the Time-Domain Aliasing Cancellation transform coding mode and the time-domain coding mode.

According to another embodiment, a method for decoding a data stream having a sequence of frames into which time segments of an information signal are coded, respectively, may have the steps of parsing the data stream, wherein parsing the data stream has reading a first syntax portion and a second syntax portion from a current frame; and reconstructing a current time segment of the information signal associated with the current frame based on information acquired from the current frame by the parsing, using a first selected one of a Time-Domain Aliasing Cancellation transform decoding mode and a time-domain decoding mode, the first selection depending on the first syntax portion, wherein, in parsing the data stream, a second selected one of a first action of expecting the current frame to have, and thus reading forward aliasing cancellation data from the current frame and a second action of not-expecting the current frame to have, and thus not reading forward aliasing cancellation data from the current frame is performed, the second selection depending on the second syntax portion, wherein the reconstructing includes performing forward aliasing cancellation at a boundary between the current time segment and a previous time segment of a previous frame using the forward aliasing cancellation data.

According to another embodiment, a method for encoding an information signal into data stream such that the data stream has a sequence of frames into which time segments of the information signal are coded, respectively, may have the steps of coding a current time segment of the information signal into information of the current frame using a first selected one of a Time-Domain Aliasing Cancellation transform encoding mode and a time-domain encoding mode; and inserting the information into the current frame along with a first syntax portion and a second syntax portion, wherein the first syntax portion signals the first selection, determining forward aliasing cancellation data for forward aliasing cancellation at a boundary between the current time segment and a previous time segment of a previous frame and inserting the forward aliasing cancellation data into the current frame in case the current frame and the previous frame are encoded using different ones of the Time-Domain Aliasing Cancellation transform encoding mode and the time-domain encoding mode, and refraining from inserting any forward aliasing cancellation data into the current frame in case the current frame and the previous frame are encoded using equal ones of the Time-Domain Aliasing Cancellation transform encoding mode and the time-domain encoding mode, wherein the second syntax portion is set depending on as to whether the current frame and the previous frame are encoded using equal or different ones of the Time-Domain Aliasing Cancellation transform encoding mode and the time-domain encoding mode.

According to another embodiment, a data stream may have a sequence of frames into which time segments of an information signal are coded, respectively, each frame having a first syntax portion, a second syntax portion, and information into which a time segment associated with the respective frame is coded using a first selected one of a Time-Domain Aliasing Cancellation transform coding mode and a time-domain coding mode, the first selection depending on the first syntax portion of the respective frame, wherein each frame includes forward aliasing cancellation data or not depending on the second syntax portion of the respective frame, wherein the second syntax portion indicates that the respective frame has forward aliasing cancellation data of the respective frame and the previous frame are coded using different ones of the Time-Domain Aliasing Cancellation transform coding mode and the time-domain coding mode so that forward aliasing cancellation using the forward aliasing cancellation data is possible at the boundary between the respective time segment and a previous time segment associated with the previous frame.

According to another embodiment, a computer program may have a program code for performing, when running on a computer, a method for decoding a data stream having a sequence of frames into which time segments of an information signal are coded, respectively, which may have the steps of parsing the data stream, wherein parsing the data stream includes reading a first syntax portion and a second syntax portion from a current frame; and reconstructing a current time segment of the information signal associated with the current frame based on information acquired from the current frame by the parsing, using a first selected one of a Time-Domain Aliasing Cancellation transform decoding mode and a time-domain decoding mode, the first selection depending on the first syntax portion, wherein, in parsing the data stream, a second selected one of a first action of expecting the current frame to include, and thus reading forward aliasing cancellation data from the current frame and a second action of not-expecting the current frame to include, and thus not reading forward aliasing cancellation data from the current frame is performed, the second selection depending on the second syntax portion, wherein the reconstructing includes performing forward aliasing cancellation at a boundary between the current time segment and a previous time segment of a previous frame using the forward aliasing cancellation data.

According to another embodiment, a computer program may have a program code for performing, when running on a computer, a method for encoding an information signal into data stream such that the data stream has a sequence of frames into which time segments of the information signal are coded, respectively, which may have the steps of coding a current time segment of the information signal into information of the current frame using a first selected one of a Time-Domain Aliasing Cancellation transform encoding mode and a time-domain encoding mode; and inserting the information into the current frame along with a first syntax portion and a second syntax portion, wherein the first syntax portion signals the first selection, determining forward aliasing cancellation data for forward aliasing cancellation at a boundary between the current time segment and a previous time segment of a previous frame and inserting the forward aliasing cancellation data into the current frame in case the current frame and the previous frame are encoded using different ones of the Time-Domain Aliasing Cancellation transform encoding mode and the time-domain encoding mode, and refraining from inserting any forward aliasing cancellation data into the current frame in case the current frame and the previous frame are encoded using equal ones of the Time-Domain Aliasing Cancellation transform encoding mode and the time-domain encoding mode, wherein the second syntax portion is set depending on as to whether the current frame and the previous frame are encoded using equal or different ones of the Time-Domain Aliasing Cancellation transform encoding mode and the time-domain encoding mode.

The present invention is based on the finding that a more error robust or frame loss robust codec supporting switching between time-domain aliasing cancellation transform coding mode and time-domain coding mode is achievable if a further syntax portion is added to the frames depending on which the parser of the decoder may select between a first action of expecting the current frame to include, and thus reading forward aliasing cancellation data from the current frame and a second action of not-expecting the current frame to include, and thus not reading forward aliasing cancellation data from the current frame. In other words, while a bit of coding efficiency is lost due to the provision of the second syntax portion, it is merely the second syntax portion which provides for the ability to use the codec in case of a communication channel with frame loss. Without the second syntax portion, the decoder would not be capable of decoding any data stream portion after a loss and will crash in trying to resume parsing. Thus, in an error prone environment, the coding efficiency is prevented from vanishing by the introduction of the second syntax portion.

BRIEF DESCRIPTION OF THE DRAWINGS

Embodiments of the present invention will be detailed subsequently referring to the appended drawings, in which:

FIGS. 15 to 19 are portions of a syntax structure in accordance with an embodiment; and FIGS. 20 to 22 are portions of a syntax structure in accordance with another embodiment.

DETAILED DESCRIPTION OF THE INVENTION

Figure 1:
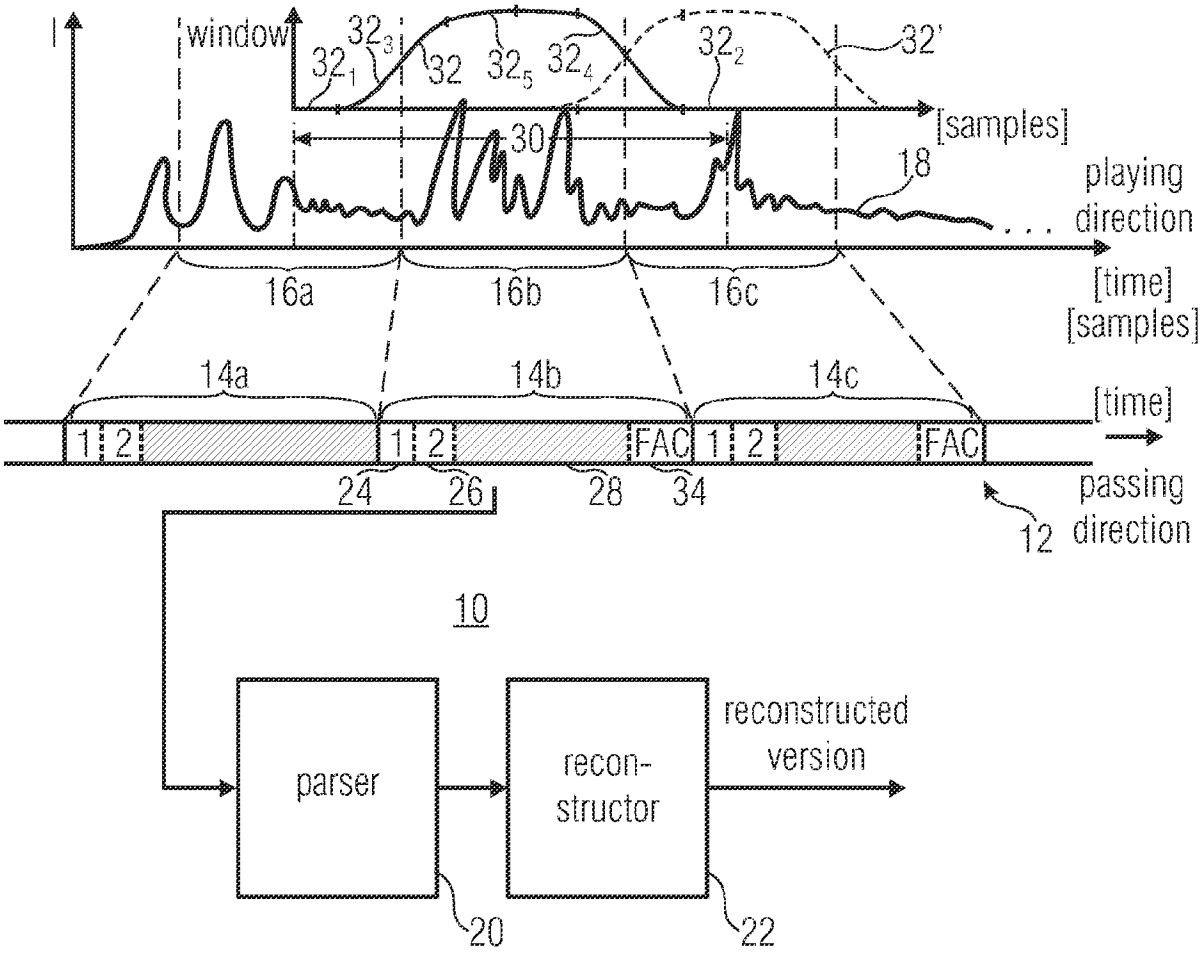
FIG. 1 is a schematic block diagram of a decoder according to an embodiment.

FIG. 1 shows a decoder 10 according to an embodiment of the present invention. Decoder 10 is for decoding a data stream comprising a sequence of frames 14*a*, 14*b* and 14*c* into which time segments 16*a*-*c* of an information signal 18 are coded, respectively. As is illustrated in FIG. 1, the time segments 16*a* to 16*c* are non-overlapping segments which directly abut each other in time and are sequentially ordered in time. As illustrated in FIG. 1, the time segments 16*a* to 16*c* may be of equal size but alternative embodiments are also feasible. Each of the time segments 16*a* to 16*c* is coded into a respective one of frames 14*a* to 14*c*. In other words, each time segment 16*a* to 16*c* is uniquely associated with one of frames 14*a* to 14*c* which, in turn, have also an order defined among them, which follows the order of the segments 16*a* to 16*c* which are coded into the frames 14*a* to 14*c*, respectively. Although FIG. 1 suggests that each frame 14*a* to 14*c* is of equal length measured in, for example, coded bits, this is, of course, not mandatory. Rather, the length of frames 14*a* to 14*c* may vary according to the complexity of the time segment 16*a* to 16*c* the respective frame 14*a* to 14*c* is associated with.

For ease of explanation of the below-outlined embodiments, it is assumed that the information signal 18 is an audio signal. However, it should be noted that the information signal could also be any other signal, such as a signal output by a physical sensor or the like, such as an optical sensor or the like. In particular, signal 18 may be sampled at a certain sampling rate and the time segments 16*a* to 16*c* may cover immediately consecutive portions of this signal 18 equal in time and number of samples, respectively. A number of samples per time segment 16*a* to 16*c* may, for example, be 1024 samples.

The decoder 10 comprises a parser 20 and a reconstructor 22. The parser 20 is configured to parse the data stream 12 and, in parsing the data stream 12, read a first syntax portion 24 and a second syntax portion 26 from a current frame 14*b*, i.e. a frame currently to be decoded. In FIG. 1, it is exemplarily assumed that frame 14*b* is the frame currently to be decoded whereas frame 14*a* is the frame which has been decoded immediately before. Each frame 14*a* to 14*c* has a first syntax portion and a second syntax portion incorporated therein with a significance or meaning thereof being outlined below. In FIG. 1, the first syntax portion within frames 14*a* to 14*c* is indicated with a box having a "1" in it and the second syntax portion indicated with a box entitled "2".

Naturally, each frame 14*a* to 14*c* also has further information incorporated therein which is for representing the associated time segment 16*a* to 16*c* in a way outlined in more detail below. This information is indicated in FIG. 1 by a hatched block wherein a reference sign 28 is used for the further information of the current frame 14*b*. The parser 20 is configured to, in parsing the data stream 12, also read the information 28 from the current frame 14*b*.

The reconstructor 22 is configured to reconstruct the current time segment 16*b* of the information signal 18 associated with the current frame 14*b* based on the further information 28 using a selected one of the time-domain aliasing cancellation transform decoding mode and a time-domain decoding mode. The selection depends on the first syntax element 24. Both decoding modes differ from each other by the presence or absence of any transition from spectral domain back to time-domain using a re-transform. The re-transform (along with its corresponding transform) introduces aliasing as far as the individual time segments are concerned which aliasing is, however, compensable by a time-domain aliasing cancellation as far as the transitions at boundaries between consecutive frames coded in the time-domain aliasing cancellation transform coding mode is concerned. The time-domain decoding mode does not necessitate any re-transform. Rather, the decoding remains in time-domain. Thus, generally speaking, the time-domain aliasing cancellation transform decoding mode of reconstructor 22 involves a re-transform being performed by reconstructor 22. This retransform maps a first number of transform coefficients as obtained from information 28 of the current frame 14*b* (being of the TDAC transform decoding mode) onto a re-transformed signal segment having a sample length of a second number of samples which is greater than the first number thereby causing aliasing. The time-domain decoding mode, in turn, may involve a linear prediction decoding mode according to which the excitation and linear prediction coefficients are reconstructed from the information 28 of the current frame which, in that case, is of the time-domain coding mode.

Thus, as became clear from the above discussion, in the time-domain aliasing cancellation transform decoding mode, reconstructor 22 obtains from information 28 a signal segment for reconstructing the information signal at the respective time segment 16*b* by a re-transform. The re-transformed signal segment is longer than the current time segment 16*b* actually is and participates in the reconstruction of the information signal 18 within a time portion which includes and extends beyond time segment 16*b*. FIG. 1 illustrates a transform window 32 used in transforming the original signal or in both, transforming and re-transforming. As can be seen, window 32 may comprise the zero portion $\mathbf{32}_1$ at the beginning thereof and a zero-portion $\mathbf{32}_2$ at a trailing end thereof, and aliasing portions $\mathbf{32}_3$ and $\mathbf{32}_4$ at a leading and trailing edge of the current time segment 16*b* wherein a non-aliasing portion $\mathbf{32}_5$ where window 32 is one, may be positioned between both aliasing portions $\mathbf{32}_3$ and $\mathbf{32}_4$. The zero-portions $\mathbf{32}_1$ and $\mathbf{32}_2$ are optional. It is also possible that merely one of the zero-portions $\mathbf{32}_1$ and $\mathbf{32}_2$ is present. As is shown in FIG. 1, the window function may be monotonically increasing/decreasing within the aliasing portions. Aliasing occurs within the aliasing portions $\mathbf{32}_3$ and $\mathbf{32}_4$ where window 32 continuously leads from zero to one or these versa. The aliasing is not critical as long as the previous and succeeding time segments are coded in the time-domain aliasing cancellation transform coding mode, too. This possibility is illustrated in FIG. 1 with respect to the time segment 16*c*. A dotted line illustrates a respective transform window 32' for time segment 16*c* the aliasing portion of which coincides with the aliasing portion $\mathbf{32}_4$ of the current time segment 16*b*. Adding the re-transformed segment signals of time segments 16*b* and 16*c* by reconstructor 22 cancels-out the aliasing of both re-transformed signal segments against each other.

However, in cases where the previous or succeeding frame 14*a* or 14*c* is coded in the time-domain coding mode, a transition between different coding modes results at the leading or trailing edge of the current time segment 16*b* and, in order to account for respective aliasing, the data stream 12 comprises forward aliasing cancellation data within the respective frame immediately following the transition for enabling the decoder 10 to compensate for the aliasing occurring at this respective transition. For example, it may happen that the current frame 14*b* is of the time-domain aliasing cancellation transform coding mode, but decoder 10 does not know as to whether the previous frame 14*a* was of the time-domain coding mode. For example, frame 14*a* may have got lost during transmission and decoder 10 has no access thereto, accordingly. However, depending on the coding mode of frame 14*a*, the current frame 14*b* comprises forward aliasing cancellation data in order to compensate for the aliasing occurring at aliasing portion $\mathbf{32}_3$ or not. Similarly, if the current frame 14*b* was of the time-domain coding mode, and the previous frame 14*a* has not been received by decoder 10, then the current frame 14*b* has forward aliasing cancellation data incorporated into it or not depending on the mode of the previous frame 14*a*. In particular, if the previous frame 14*a* was of the other coding mode, i.e. time-domain aliasing cancellation transform coding mode, then forward aliasing cancellation data would be present in the current frame 14*b* in order to cancel the aliasing otherwise occurring at boundary between time segments 16*a* and 16*b*. However, if the previous frame 14*a* was of the same coding mode, i.e. time-domain coding mode, then parser 20 would not have to expect forward aliasing cancellation data to be present in the current frame 14*b*.

Accordingly, the parser 20 exploits a second syntax portion 26 in order to ascertain as to whether forward aliasing cancellation data 34 is present in the current frame 14*b* or not. In parsing the data stream 12, parser 20 may selected one of a first action of expecting the current frame 14*b* to comprise, and thus reading forward aliasing cancellation data 34 from the current frame 14*b* and a second action of not-expecting the current frame 14*b* to comprise, and thus not reading forward aliasing cancellation data 34 from the current frame 14*b*, the selection depending on the second syntax portion 26. If present, the reconstructor 22 is configured to perform forward aliasing cancellation at the boundary between the current time segment 16*b* and the previous time segment 16*a* of the previous frame 14*a* using the forward aliasing cancellation data.

Thus, compared to the situation where the second syntax portion is not present, the decoder of FIG. 1 does not have to discard, or unsuccessfully interrupt parsing, the current frame 14*b* even in case the coding mode of the previous frame 14*a* is unknown to the decoder 10 due to frame loss, for example. Rather, decoder 10 is able to exploit the second syntax portion 26 in order to ascertain as to whether the current frame 14*b* has forward aliasing cancellation data 34 or not. In other words, the second syntax portion provides for a clear criterion on as to whether one of the alternatives, i.e. FAC data for the boundary to the preceding frame being present or not, applies and ensures that any decoder may behave the same irrespective from their implementation, even in case of frame loss. Thus, the above-outlined embodiment introduces mechanisms to overcome the problem of frame loss.

Figure 2:
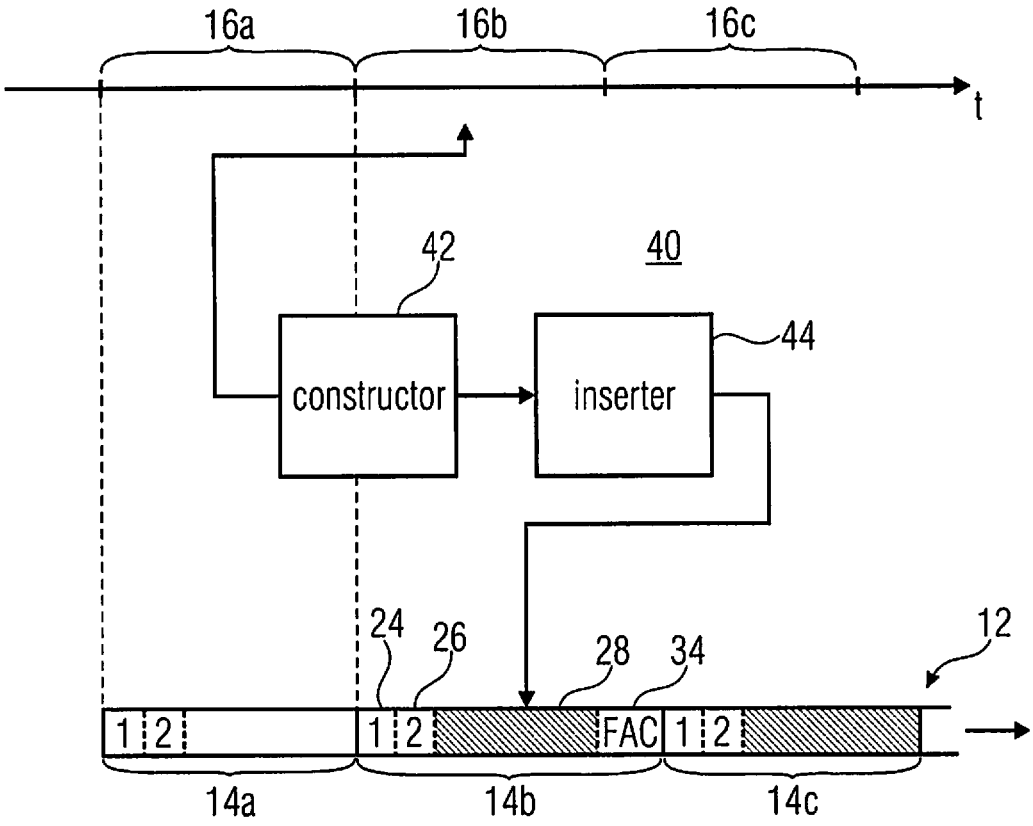
FIG. 2 is a schematic block diagram of an encoder according to an embodiment.

Before describing more detailed embodiments further below, an encoder able to generate the data stream 12 of FIG. 1 is described with the respective FIG. 2. The encoder of FIG. 2 is generally indicated with reference sign 40 and is for encoding the information signal into the data stream 12 such that the data stream 12 comprises the sequence of frames into which the time segments 16*a* to 16*c* of the information signal are coded, respectively. The encoder 40 comprises a constructor 42 and an inserter 44. The constructor is configured to code a current time segment 16*b* of the information signal into information of the current frame 14*b* using a first selected one of a time-domain aliasing cancellation transform coding mode and a time-domain coding mode. The inserter 44 is configured to insert the information 28 into the current frame 14*b* along with a first syntax portion 24 and a second syntax portion 26, wherein the first syntax portion signals the first selection, i.e. the selection of the coding mode. The constructor 42, in turn, is configured to determine forward aliasing cancellation data for forward aliasing cancellation at a boundary between the current time segment 16*b* and a previous time segment 16*a* of a previous frame 14*a* and inserts forward aliasing cancellation data 34 into the current frame 14*b* in case the current frame 14*b* and the previous frame 14*a* are encoded using different ones of a time-domain aliasing cancellation transform coding mode and a time-domain coding mode, and refraining from inserting any forward aliasing cancellation data into the current frame 14*b* in case the current frame 14*b* and the previous frame 14*a* are encoded using equal ones of the time-domain aliasing cancellation transform coding mode and the time-domain coding mode. That is, whenever constructor 42 of encoder 40 decides that it is advantageous, in some optimization sense, to switch from one of both coding modes to the other, constructor 42 and inserter 44 are configured to determine and insert forward aliasing cancellation data 34 into the current frame 14*b*, while, if keeping the coding mode between frames 14*a* and 14*b*, FAC data 34 is not inserted into the current frame 14*b*. In order to enable the decoder to derive from the current frame 14*b*, without knowledge of the content of the previous frame 14*a*, as to whether FAC data 34 is present within the current frame 14*b* or not, the second syntax portion 26 is set depending on as to whether the current frame 14*b* and the previous frame 14*a* are encoded using equal or different ones of the time-domain aliasing cancellation transform coding mode and the time-domain coding mode. Specific examples for realizing the second syntax portion 26 will be outlined below.

In the following, an embodiment is described according to which a codec, a decoder and an encoder of the above described embodiments belong to, supports a special type of frame structure according to which the frames 14*a* to 14*c* themselves are the subject to sub-framing, and two distinct versions of the time-domain aliasing cancellation transform coding mode exist. In particular, according to these embodiments further described below, the first syntax portion 24 associates the respective frame from which same has been read, with a first frame type called FD (frequency domain) coding mode in the following, or a second frame type called LPD coding mode in the following, and, if the respective frame is of the second frame type, associates sub-frames of a sub-division of the respective frame, composed of a number of sub-frames, with a respective one of a first sub-frame type and a second sub-frame type. As will outlined in more detail below, the first sub-frame type may involve the corresponding sub-frames to be TCX coded while the second sub-frame type may involve this respective sub-frames to be coded using ACELP, i.e. Adaptive Codebook Excitation Linear Prediction. Either, any other codebook excitation linear prediction coding mode may be used as well.

Figure 3:
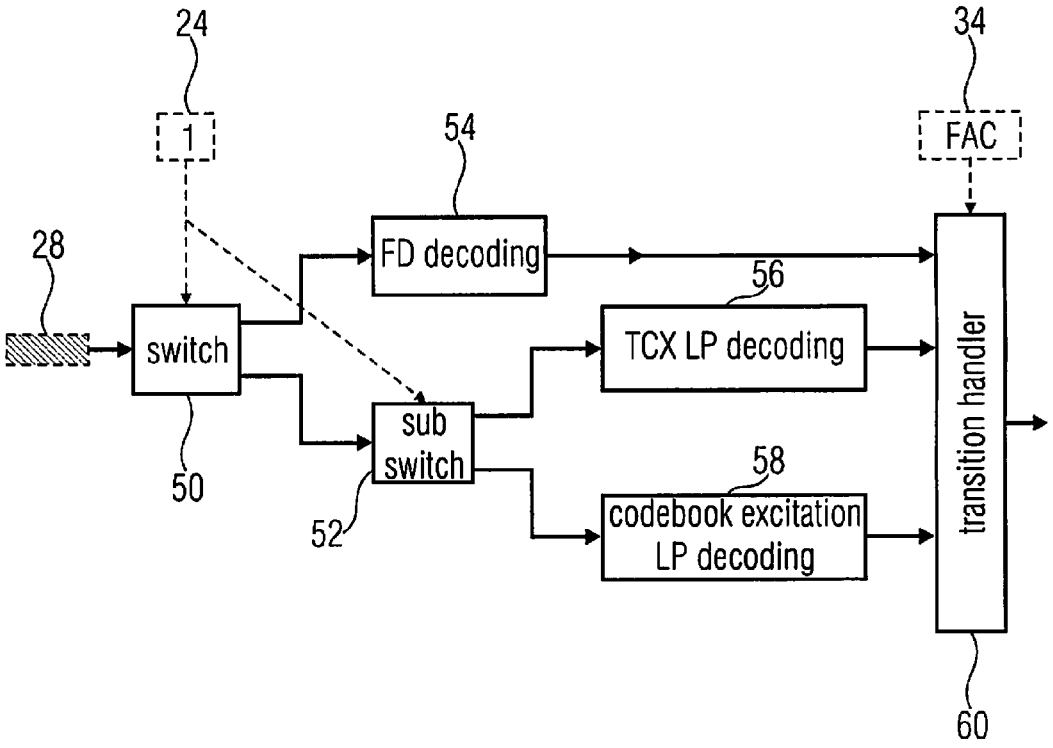
FIG. 3 is a block diagram of a possible implementation of the reconstructor of FIG. 2.

The reconstructor 22 of FIG. 1 is configured to handle these different coding mode possibilities. To this end, the reconstructor 22 may be constructed as depicted in FIG. 3. According to the embodiment of FIG. 3, the reconstructor 22 comprises two switches 50 and 52 and three decoding modules 54, 56 and 58 each of which is configured to decode frames and sub-frames of specific type as will be described in more detail below.

Switch 50 has an input at which the information 28 of the currently decoded frame 14*b* enters, and a control input via which switch 50 is controllable depending on the first syntax portion 24 of the current frame. Switch 50 has two outputs one of which is connected to the input of decoding module 54 responsible for FD decoding (FD=frequency domain), and the other one of which is connected to the input of sub-switch 52 which has also two outputs one of which is connected to an input decoding module 56 responsible for transform coded excitation linear prediction decoding, and the other one of which is connected to an input of module 58 responsible for codebook excitation linear prediction decoding. All coding modules 54 to 58 output signal segments reconstructing the respective time segments associated with the respective frames and sub-frames from which these signal segments have been derived by the respective decoding mode, and a transition handler 60 receives the signal segments at respective inputs thereof in order to perform the transition handling and aliasing cancellation described above and described in more detail below in order to output at its output of the reconstructed information signal. Transition handler 60 uses the forward aliasing cancellation data 34 as illustrated in FIG. 3.

According to the embodiment of FIG. 3, the reconstructor 22 operates as follows. If the first syntax portion 24 associates the current frame with a first frame type, FD coding mode, switch 50 forwards the information 28 to FD decoding module 54 for using frequency domain decoding as a first version of the time-domain aliasing cancellation transform decoding mode to reconstruct the time segment 16*b* associated with the current frame 14*b*. Otherwise, i.e. if the first syntax portion 24 associates the current frame 14*b* with the second frame type, LPD coding mode, switch 50 forwards information 28 to sub-switch 52 which, in turn, operates on the sub-frame structure of the current frame 14. To be more precise, in accordance with the LPD mode, a frame is divided into one or more sub-frames, the sub-division corresponding to a sub-division of the corresponding time segment 16*b* into un-overlapping sub-portions of the current time segment 16*b* as it will be outlined in more detail below with respect to the following figures. The syntax portion 24 signals for each of the one or more sub-portions as to whether same is associated with a first or a second sub-frame type, respectively. If a respective sub-frame is of the first sub-frame type sub-switch 52 forwards the respective information 28 belonging to that sub-frame to the TCX decoding module 56 in order to use transform coded excitation linear prediction decoding as a second version of the time-domain aliasing cancellation transform decoding mode to reconstruct the respective sub-portion of the current time segment 16*b*. If, however, the respective sub-frame is of the second sub-frame type sub-switch 52 forwards the information 28 to module 58 in order to perform codebook excitation linear prediction coding as the time-domain decoding mode to reconstruct the respective sub-portion of the current time signal 16*b*.

The reconstructed signal segments output by modules 54 to 58 are put together by transition handler 60 in the correct (presentation) time order with performing the respective transition handling and overlap-add and time-domain aliasing cancellation processing as described above and described in more detail below.

Figure 4:
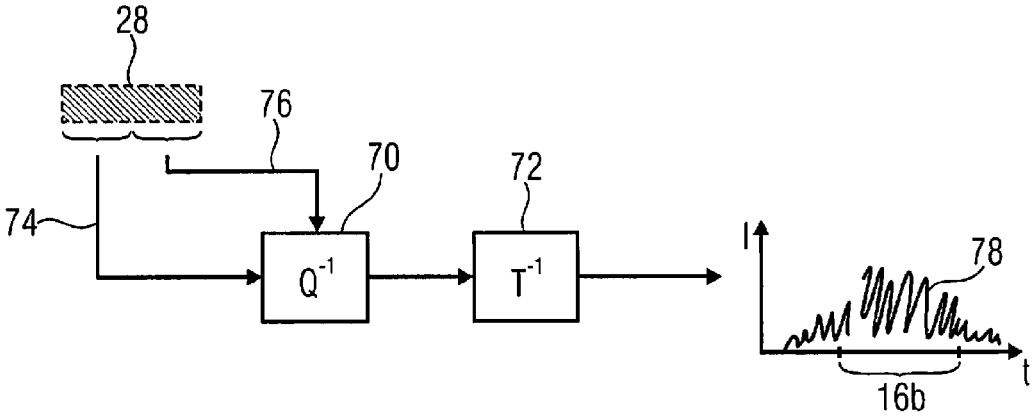
FIG. 4 is a block diagram of a possible implementation of the FD decoding module of FIG. 3.

In particular, the FD decoding module 54 may be constructed as shown in FIG. 4 and operate as describe below. According to FIG. 4, the FD decoding module 54 comprises a de-quantizer 70 and a re-transformer 72 serially connected to each other. As described above, if the current frame 14*b* is an FD frame, same is forwarded to module 54 and the de-quantizer 70 performs a spectral varying de-quantization of transform coefficient information 74 within information 28 of the current frame 14*b* using scale factor information 76 also comprised by information 28. The scale factors have been determined at encoder side using, for example, psycho acoustic principles so as to keep the quantization noise below the human masking threshold.

Re-transformer 72 then performs a re-transform on the de-quantized transform coefficient information to obtain a re-transformed signal segment 78 extending, in time, over and beyond the time segment 16*b* associated with the current frame 14*b*. As will be outlined in more detail below, the re-transform performed by re-transformer 72 may be an IMDCT (Inverse Modified Discrete Cosine Transform) involving a DCT IV followed by an unfolding operation wherein after a windowing is performed using a re-transform window which might be equal to, or deviate from, the transform window used in generating the transform coefficient information 74 by performing the afore-mentioned steps in the inverse order, namely windowing followed by a folding operation followed by a DCT IV followed by the quantization which may be steered by psycho acoustic principles in order to keep the quantization noise below the masking threshold.

It is worthwhile to note that the amount of transform coefficient information 28 is due to the TDAC nature of the re-transform of re-transformer 72, lower than the number of samples which the reconstructed signal segment 78 is long. In case of IMDCT, the number of transform coefficients within information 74 is rather equal to the number of samples of time segment 16*b*. That is, the underlying transform may be called a critically sampling transform necessitating time-domain aliasing cancellation in order to cancel the aliasing occurring due to the transform at the boundaries, i.e. the leading and trailing edges of the current time segment 16*b*.

As a minor note it should be noted that similar to the sub-frame structure of LPD frames, the FD frames could be the subject of a sub-framing structure, too. For example, FD frames could be of long window mode in which a single window is used to window a signal portion extending beyond the leading and trailing edge of the current time segment in order to code the respective time segment, or of a short window mode in which the respective signal portion extending beyond the borders of the current time segment of the FD frame is sub-divided into smaller sub-portions each of which is subject to a respective windowing and transform individually. In that case, FD coding module 54 would output a re-transformed signal segment for sub-portion of the current time segment 16*b*.

Figure 5:
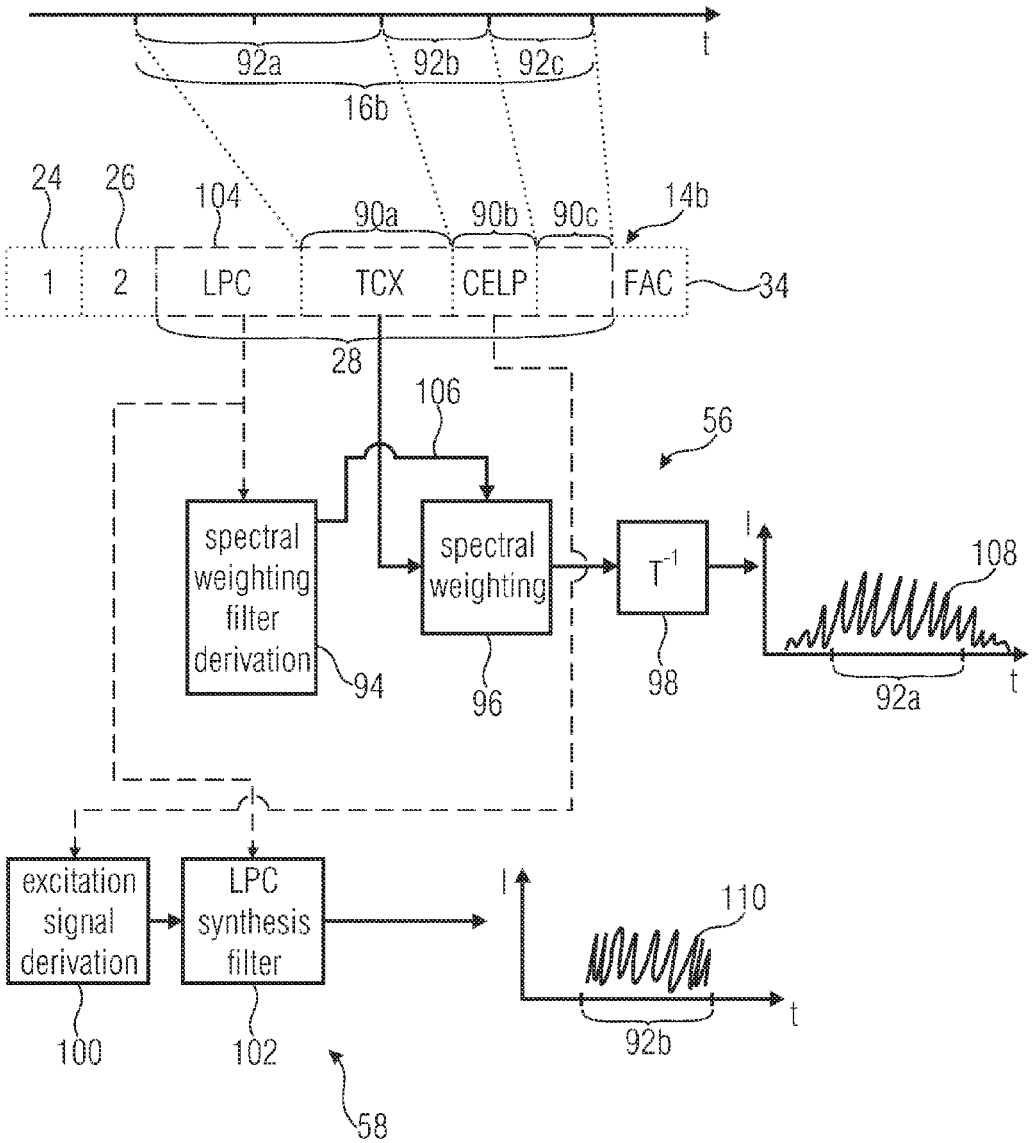
FIG. 5 is a block diagram of possible implementation of the linear prediction domain (LPD) decoding modules of FIG. 3.

After having described a possible implementation of the FD coding module 54, a possible implementation of the TCX LP decoding module and the codebook excitation LP decoding module 56 and 58, respectively, is described with respect to FIG. 5. In other words, FIG. 5 deals with the case where the current frame is an LPD frame. In that case, the current frame 14*b* is structured into one or more sub-frames. In the present case a structuring into three sub-frames 90*a*, 90*b* and 90*c* is illustrated. It might be that a structuring is, by default, restricted to certain sub-structuring possibilities. Each of the sub-portions is associated with a respective one of sub-portions 92*a*, 92*b* and 92*c* of the current time segment 16*b*. That is, the one or more sub-portions 92*a* to 92*c* gap-less cover, without overlap, the whole time segment 16*b*. According to the order of the sub-portions 92*a* to 92*c* within the time segment 16*b*, a sequential order is defined among the sub-frames 92*a* to 92*c*. As is illustrated in FIG. 5, the current frame 14*b* is not completely sub-divided into the sub-frames 90*a* to 90*c*. In even other words, some portions of the current frame 14*b* belong to all sub-frames commonly such as the first and second syntax portions 24 and 26, the FAC data 34 and potentially further data as the LPC information as will be described below in further detail although the LPC information may also be sub-structured into the individual sub-frames.

In order to deal with the TCX sub-frames the TCX LP decoding module 56 comprises a spectral weighting derivator 94, a spectral weighter 96 and a re-transformer 98. For illustration of purposes, the first sub-frame 90*a* is shown to be a TCX sub-frame, whereas the second sub-frame 90*b* is assumed to be ACELP sub-frame.

In order to process the TCX sub-frame 90*a*, derivator 94 derives a spectral weighting filter from LPC information 104 within information 28 of the current frame 14*b*, and spectral weighter 96 spectrally weights transform coefficient information within the respect of sub-frame 90*a* using the spectral weighting filter received from derivator 94 as shown by arrow 106.

Re-transformer 98, in turn, re-transforms the spectrally weighted transform coefficient information to obtain a re-transformed signal segment 108 extending, in time t, over and beyond the sub-portion 92*a* of the current time segment. The re-transform performed by re-transformer 98 may be the same as performed by re-transformer 72. In effect, re-transformer 72 and 98 may have hardware, a software-routine or a programmable hardware portion in common.

The LPC information 104 comprised by the information 28 of the current LPD frame 14*b* may represent LPC coefficients of one-time instant within time segment 16*b* or for several time instances within time segment 16*b* such as one set of LPC coefficients for each sub-portion 92*a* to 92*c*. The spectral weighting filter derivator 94 converts the LPC coefficients into spectral weighting factors spectrally weighting the transform coefficients within information 90*a* according to a transfer function which is derived from the LPC coefficients by derivator 94 such that same substantially approximates the LPC synthesis filter or some modified version thereof. Any de-quantization performed beyond the spectral weighting by weighter 96, may be spectrally invariant. Thus, differing from FD decoding mode, the quantization noise according to the TCX coding mode is spectrally formed using LPC analysis.

Due to the use of the re-transform, however, the re-transformed signal segment 108 suffers from aliasing. By using the same re-transform, however, re-transform signal segments 78 and 108 of consecutive frames and sub-frames, respectively, may have their aliasing cancelled out by transition handler 60 merely by adding the overlapping portions thereof.

In processing the (A)CELP sub-frames 90*b*, the excitation signal derivator 100 derives an excitation signal from excitation update information within the respective sub-frame 90*b* and the LPC synthesis filter 102 performs LPC synthesis filtering on the excitation signal using the LPC information 104 in order to obtain an LP synthesized signal segment 110 for the sub-portion 92*b* of the current time segment 16*b*.

Derivators 94 and 100 may be configured to perform some interpolation in order to adapt the LPC information 104 within the current frame 14*b* to the varying position of the current sub-frame corresponding to the current sub-portion within the current time segment 16*b*.

Commonly describing FIGS. 3 to 5, the various signal segments 108, 110 and 78 enter transition handler 60 which, in turn, puts together all signal segments in the correct time order. In particular, the transition handler 60 performs time-domain aliasing cancellation within temporarily overlapping window portions at boundaries between time segments of immediately consecutive ones of FD frames and TCX sub-frames to reconstruct the information signal across these boundaries. Thus, there is no need for forward aliasing cancellation data for boundaries between consecutive FD frames, boundaries between FD frames followed by TCX frames and TCX sub-frames followed by FD frames, respectively.

However, the situation changes whenever an FD frame or TCX sub-frame (both representing a transform coding mode variant) precedes an ACELP sub-frame (representing a form of time domain coding mode). In that case, transition handler 60 derives a forward aliasing cancellation synthesis signal from the forward aliasing cancellation data from the current frame and adds the first forward aliasing cancellation synthesis signal to the re-transformed signal segment 100 or 78 of the immediately preceding time segment to re-construct the information signal across respective the boundary. If the boundary falls into the inner of the current time segment 16*b* because a TCX sub-frame and an ACELP sub-frame within the current frame define the boundary between the associated time segment sub-portions, transition handler may ascertain the existence of the respective forward aliasing cancellation data for these transitions from first syntax portion 24 and the sub-framing structure defined therein. The syntax portion 26 is not needed. The previous frame 14*a* may have got lost or not.

However, in case of the boundary coinciding with the boundary between consecutive time segments 16*a* and 16*b*, parser 20 has to inspect the second syntax portion 26 within the current frame in order to determine as to whether the current frame 14*b* has forward aliasing cancellation data 34, the FAC data 34 being for cancelling aliasing occurring at the leading end of the current time segment 16*b*, because either the previous frame is an FD frame or the last sub-frame of the preceding LPD frame is a TCX sub-frame. At least, parser 20 needs to know syntax portion 26 in case, the content of the previous frame got lost.

Similar statements apply for transitions into the other direction, i.e. from ACELP sub-frames to FD frames or TCX frames. As long as the respective boundaries between the respective segments and segment sub-portions fall within the inner of the current time segment, the parser 20 has no problem in determining the existence of the forward aliasing cancellation data 34 for these transitions from the current frame 14*b* itself, namely from the first syntax portion 24. The second syntax portion is not needed and is even irrelevant. However, if the boundary occurs at, or coincides with, a boundary between the previous time segment 16*a* and the current time segment 16*b*, parser 20 needs to inspect the second syntax portion 26 in order to determine as to whether forward aliasing cancellation data 34 is present for the transition at the leading end of the current time segment 16*b* or not—at least in case of having no access to the previous frame.

In case of transitions from ACELP to FD or TCX, the transition handler 60 derives a second forward aliasing cancellation synthesis signal from the forward aliasing cancellation data 34 and adds the second forward aliasing cancellation synthesis signal to the re-transformed signal segment within the current time segment in order to reconstruct the information signal across the boundary.

After having described embodiments with regard to FIGS. 3 to 5 which generally referred to an embodiment according to which frames and sub-frames of different coding modes existed, a specific implementation of these embodiments will be outlined in more detail below. The description of these embodiments concurrently includes possible measures in generating the respective data stream comprising such frames and sub-frames, respectively. In the following, this specific embodiment is described as an unified speech and audio codec (USAC) although the principles outlined therein would also be transferrable to other signals.

Window switching in USAC has several purposes. It mixes FD frames, i.e. frames encoded with frequency coding, and LPD frames which are, in turn, structured into ACELP (sub-) frames and TCX (sub-)frames. ACELP frames (time-domain coding) apply a rectangular, non-overlapping windowing to the input samples while TCX frames (frequency-domain coding) apply a non-rectangular, overlapping windowing to the input samples and then encode the signal using a time-domain aliasing cancellation (TDAC) transform, namely the MDCT, for example. To harmonize the overall windows, TCX frames may use centered windows with homogeneous shapes and to manage the transitions at ACELP frame boundaries, explicit information for cancelling the time-domain aliasing and windowing effects of the harmonized TCX windows are transmitted. This additional information can be seen as forward aliasing cancellation (FAC). FAC data is quantized in the following embodiment in the LPC weighted domain so that quantization noises of FAC and decoded MDCT are of the same nature.

Figure 6:
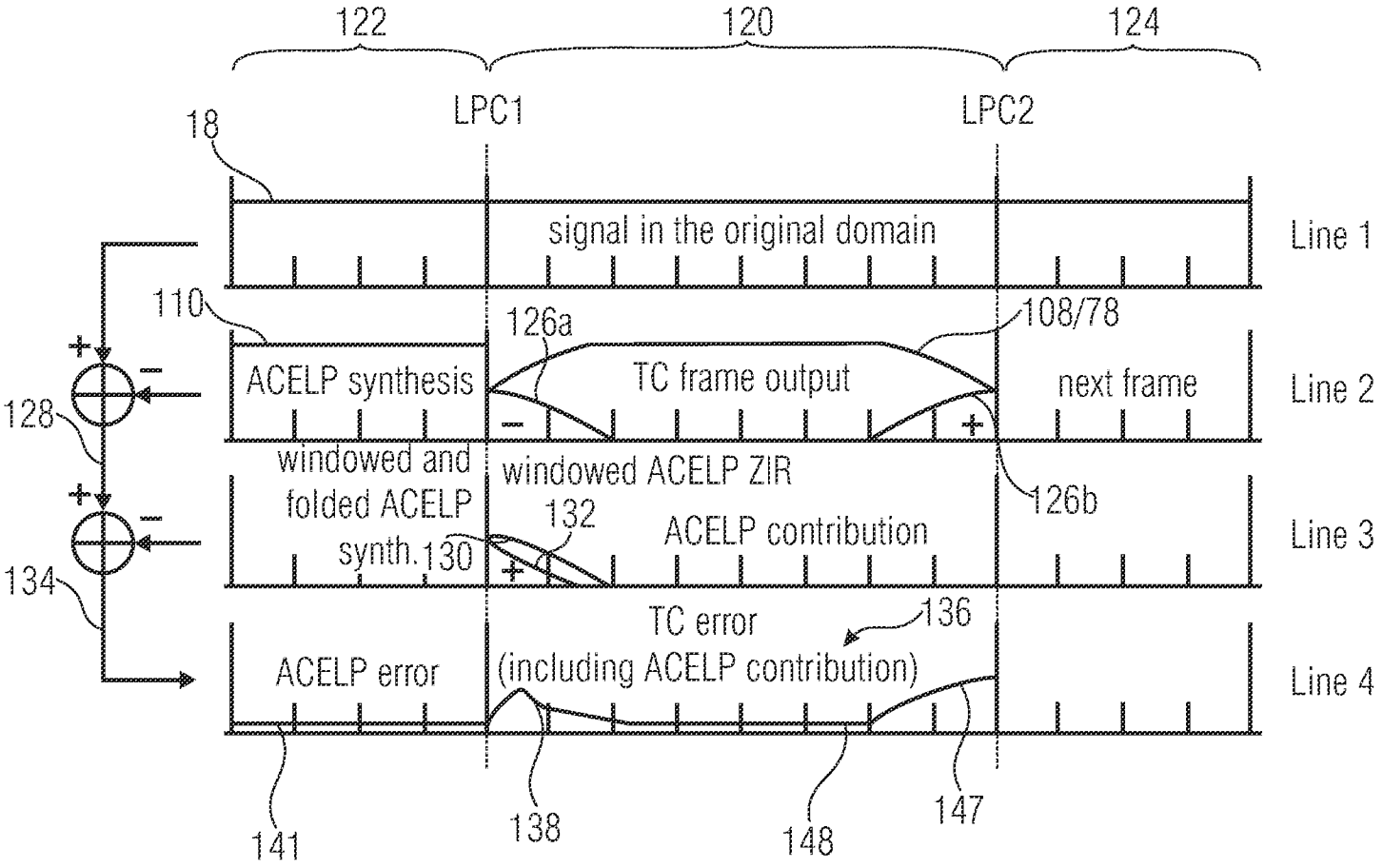
FIG. 6 is schematic diagram illustrating the encoding procedure in order to generate FAC data in accordance with an embodiment.

FIG. 6 shows the processing at the encoder in a frame 120 encoded with transform coding (TC) which is preceded and followed by a frame 122, 124 encoded with ACELP. In line with the above discussion, the notion of TC includes MDCT over long and short blocks using AAC, as well as MDCT based TCX. That is, frame 120 may either be an FD frame or an TCX (sub-)frame as the sub-frame 90*a*, 92*a* in FIG. 5, for example. FIG. 6 shows time-domain markers and frame boundaries. Frame or time segment boundaries are indicated by dotted lines while the time-domain markers are the short vertical lines along the horizontal axes. It should be mentioned that in the following description the terms "time segment" and "frame" are sometimes used synonymously due to the unique association there between.

Thus, the vertical dotted lines in FIG. 6 show the beginning and end of the frame 120 which may be a sub-frame/time segment subpart or a frame/time segment. LPC1 and LPC2 shall indicate the center of an analysis window corresponding to LPC filter coefficients or LPC filters which are used in the following in order to perform the aliasing cancellation. These filter coefficients are derived at the decoder by, for example, the reconstructor 22 or the derivators 94 and 100 by use of interpolation using the LPC information 104 (see FIG. 5). The LPC filters comprise: LPC1 corresponding to a calculation thereof at the beginning of the frame 120, and LPC2 corresponding to a calculation thereof at the end of frame 120. Frame 122 is assumed to have been encoded with ACELP. The same applies to frame 124.

FIG. 6 is structured into four lines numbered at the right hand side of FIG. 6. Each line represents a step in the processing at the encoder. It is to be understood that each line is time alined with the line above.

Line 1 of FIG. 6 represents the original audio signal, segmented in frames 122, 120 and 124 as stated above. Hence, at the left of marker "LPC1", the original signal is encoded with ACELP. Between markers "LPC1" and "LPC2", the original signal is encoded using TC. As described above, in TC the noise shaping is applied directly in the transform domain rather than in the time domain. To the right of marker LPC2, the original signal is again encoded with ACELP, i.e. a time domain coding mode. This sequence of coding modes (ACELP then TC then ACELP) is chosen so as to illustrate the processing in FAC since FAC is concerned with both transitions (ACELP to TC and TC to ACELP).

Note, however, that the transitions at LPC1 and LPC2 in FIG. 6 may occur within the inner of a current time segment or may coincide with the leading end thereof. In the first case, the determination of the existence of the associated FAC data may be performed by parser 20 merely based on the first syntax portion 24, whereas in case of frame loss, parser 20 may need the syntax portion 26 to do so in the latter case.

Line 2 of FIG. 6 corresponds to the decoded (synthesis) signals in each of frames 122, 120 and 124. Accordingly, the reference sign 110 of FIG. 5 is used within frame 122 corresponding to the possibility that the last sub-portion of frame 122 is an ACELP encoded sub-portion like 92*b* in FIG. 5, while a reference sign combination 108/78 is used in order to indicated the signal contribution for frame 120, analogously to FIGS. 5 and 4. Again, at the left of marker LPC1, the synthesis of that frame 122 is assumed to have been encoded with ACELP. Hence, the synthesis signal 110 at the left of marker LPC1 is identified as an ACELP synthesis signal. There is, in principle, a high similarity between the ACELP synthesis and the original signal in that frame 122 since ACELP attempts to encode the wave form as accurately as possible. Then, the segment between markers LPC1 and LPC2 on line 2 of FIG. 6 represents the output of the inverse MDCT of that segment 120 as seen at the decoder. Again, segment 120 may be the time segment 16*b* of an FD frame or a sub-portion of a TCX coded sub-frame, such as 90*a* in FIG. 5, for example. In the figure, this segment 108/78 is named "TC frame output". In FIGS. 4 and 5, this segment was called re-transformed signal segment. In case of frame/segment 120 being a TCX segment sub-part, the TC frame output represents a re-windowed TLP synthesis signal, where TLP stands for "Transform-coding with Linear Prediction" to indicate that in case of TCX, noise shaping of the respective segment is accomplished in the transform domain by filtering the MDCT coefficients using spectral information from the LPC filters LPC1 and LPC2, respectively, what has also been described above with respect to FIG. 5 with regard to spectral weighter 96. Note also, that the synthesis signal, i.e. the preliminarily re-constructed signal including the aliasing, between markers "LPC1" and "LPC2" on line 2 of FIG. 6, i.e. signal 108/78, contains windowing effects and time-domain aliasing at its beginning and end. In case of MDCT as the TDAC transform, the time-domain aliasing may be symbolized as unfoldings 126*a* and 126*b*, respectively. In other words, the upper curve in line 2 of FIG. 6 which extends from the beginning to the end of that segment 120 and is indicated with reference signs 108/78, shows the windowing effect due to the transform windowing being flat in the middle in order to leave the transformed signal unchanged, but not at the beginning and end. The folding effect is shown by the lower curves 126*a* and 126*b* at the beginning and end of the segment 120 with the minus sign at the beginning of the segment and the plus sign at the end of the segment. This windowing and time-domain aliasing (or folding) effect is inherent to the MDCT which serves as an explicit example for TDAC transforms. The aliasing can be cancelled when two consecutive frames are encoded using the MDCT as it has been described above. However, in case where the "MDCT coded" frame 120 is not preceded and/or followed by other MDCT frames, its windowing and time-domain aliasing is not cancelled and remains in the time-domain signal after the inverse MDCT. Forward aliasing cancellation (FAC) can then be used to correct these effects as has been described above. Finally, the segment 124 after marker LPC2 in FIG. 6 is also assumed to be encoded using ACELP. Note that to obtain the synthesis signal in that frame, the filter states of the LPC filter 102 (see FIG. 5), i.e. the memory of long-term and short-term predictors, at the beginning of the frame 124 are to be set properly which implies that the time-aliasing and windowing effects at the end of the previous frame 120 between markers LPC1 and LPC2 is to be cancelled by the application of FAC in a specific way which will be explained below. To summarize, line 2 in FIG. 6 contains the synthesis of preliminary reconstructed signals from the consecutive frames 122, 120 and 124, including the effect of windowing in time-domain aliasing at the output of the inverse MDCT for the frame between markers LPC1 and LPC2.

To obtain line 3 of FIG. 6, the difference between line 1 of FIG. 6, i.e. in the original audio signal 118, and line 2 of FIG. 6, i.e. the synthesis signals 110 and 108/78, respectively, as described above, is computed. This yields a first difference signal 128.

The further processing at the encoder side regarding frame 120 is explained in the following with respect to line 3 of FIG. 6. At the beginning of frame 120, firstly, two contributions taken from the ACELP synthesis 110 at the left of marker LPC1 on line 2 of FIG. 6, are added to each other as follows:

The first contribution 130 is a windowed and time-reversed (of folded) version of the last ACELP synthesis samples, i.e. the last samples of signal segment 110 shown in FIG. 5. The window length and shape for this time-reversed signal is the same as the aliasing part of the transform window to the left of frame 120. This contribution 130 can be seen as a good approximation of the time-domain aliasing present in the MDCT frame 120 of line 2 in FIG. 6.

The second contribution 132 is a windowed zero-input response (ZIR) of the LPC1 synthesis filter with the initial state taken as the final states of this filter at the end of the ACELP synthesis 110, i.e. at the end of frame 122. The window length and shape of this second contribution may be the same as for the first contribution 130.

With new line 3 in FIG. 6, i.e. after adding the two contributions 130 and 132 above, a new difference is taken by the encoder to obtain line 4 in FIG. 6. Note that the difference signal 134 stops at marker LPC2. An approximate view of the expected envelope of the error signal in the time-domain is shown on line 4 in FIG. 6. The error in the ACELP frame 122 is expected to be approximately flat in amplitude in the time-domain. Then, the error in the TC frame 120 is expected to exhibit the general shape, i.e. time-domain envelope, as shown in this segment 120 of line 4 in FIG. 6. This expected shape of the error amplitude is only shown here for illustration purposes.

Note that if the decoder were to use only the synthesis signals of line 3 in FIG. 6 to produce or reconstruct the decoded audio signal, then the quantization noise would be typically as the expected envelope of the error signal 136 on line 4 of FIG. 6. It is thus to be understood that a correction should be sent to the decoder to compensate for this error at the beginning and end of the TC frame 120. This error comes from the windowing and time-domain aliasing effects inherent to the MDCT/inverse MDCT pair. The windowing and time-domain aliasing have been reduced at the beginning of the TC frame 120 by adding the two contributions 132 and 130 from the previous ACELP frame 122 as stated above, but cannot be completely cancelled as in the actual TDAC operation of consecutive MDCT frames. At the right of the TC frame 120 on line 4 in FIG. 6 just before marker LPC2, all the windowing and time-domain aliasing remains from the MDCT/inverse MDCT pair and has to be, thus, completely cancelled by forward aliasing cancellation.

Figure 7:
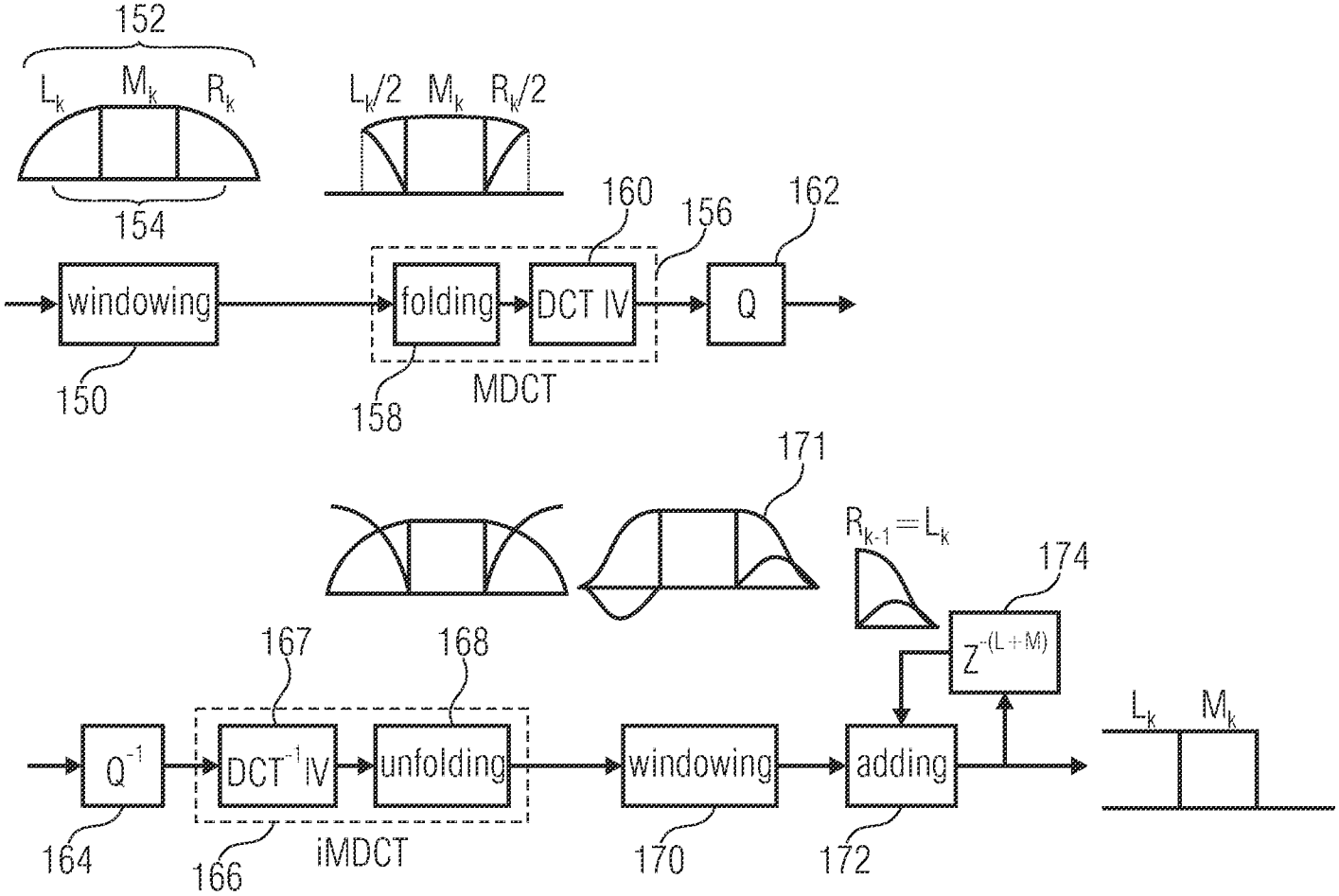
FIG. 7 is a schematic diagram of the possible TDAC transform re-transform in accordance with an embodiment.

Before proceeding to describe the encoding process in order to obtain the forward aliasing cancellation data, reference is made to FIG. 7 in order to briefly explain the MDCT as one example of TDAC transform processing. Both transform directions are depicted and described with respect to FIG. 7. The transition from time-domain to transform-domain is illustrated in the upper half of FIG. 7, whereas the re-transform is depicted in the lower part of FIG. 7.

In transitioning from the time-domain to transform-domain, the TDAC transform involves a windowing 150 applied to an interval 152 of the signal to be transformed which extends beyond the time segment 154 for which the later resulting transform coefficients are actually be transmitted within the data stream. The window applied in the windowing 150 is shown in FIG. 7 as comprising an aliasing part $L_k$ crossing the leading end of time segment 154 and an aliasing part $R_k$ at a rear end of time segment 154 with a non-aliasing part $M_k$ extending therebetween. An MDCT 156 is applied to the windowed signal. That is, a folding 158 is performed so as to fold a first quarter of interval 152 extending between the leading end of interval 152 and the leading end of time segment 154 back along the left hand (leading) boundary of time segment 154. The same is done with regard to aliasing portion $R_k$. Subsequently, a DCT IV 160 is performed on the resulting windowed and folded signal having as much samples as time signal 154 so as to obtain transform coefficients of the same number. A conversion is performed then at 162. Naturally, the quantization 162 may be seen as being not comprised by the TDAC transform.

A re-transform does the reverse. That is, following a dequantization 164, an IMDCT 166 is performed involving, firstly, a $DCT^{-1}$ IV 167 so as to obtain time samples the number of which equals the number of samples of the time segment 154 to be re-constructed. Thereafter, an unfolding process 168 is performed on the inversely transformed signal portion received from module 167 thereby expanding the time interval or the number of time samples of the IMDCT result by doubling the length of the aliasing portions. Then, a windowing is performed at 170, using a re-transform window 172 which may be same as the one used by windowing 150, but may also be different. The remaining blocks in FIG. 7 illustrate the TDAC or overlap/add processing performed at the overlapping portions of consecutive segments 154, i.e. the adding of the unfolded aliasing portions thereof, as performed by the transition handler in FIG. 3. As illustrated in FIG. 7, the TDAC by blocks 172 and 174 results in aliasing cancellation.

The description of FIG. 6 is now proceeded further. To efficiently compensate windowing and time-domain aliasing effects at the beginning and end of the TC frame 120 on line 4 of FIG. 6, and assuming that the TC frame 120 uses frequency-domain noise shaping (FDNS), forward aliasing correction (FAC) is applied following the processing described in FIG. 8. First, it should be noted that FIG. 8 describes this processing for both, the left part of the TC frame 120 around marker LPC1, and for the right part of the TC frame 120 around marker LPC2. Recall that the TC frame 120 in FIG. 6 are assumed to be preceded by an ACELP frame 122 at the LPC1 marker boundary and followed by an ACELP frame 124 at the LPC2 marker boundary.

Figure 8:
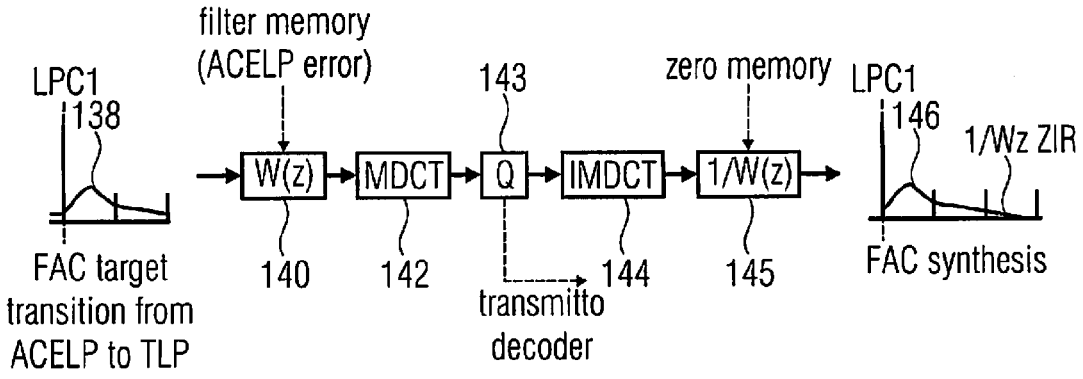
FIG. 8, 9 are block diagrams for illustrating a path lineation of the FAC data at the encoder of a further processing in the encoder in order to test the coding mode change in an optimization sense.

To compensate for the windowing and time-domain aliasing effects around marker LPC1, the processing is described in FIG. 8. First, a weighting filter W(z) is computed from the LPC1 filter. The weighting filter W(z) might be a modified analysis or whitening filter A(z) of LPC1. For example $W(z)=A(z/\lambda)$ with $\lambda$ being a predetermined weighting factor. The error signal at the beginning of the TC frame is indicated with reference sign 138 just as it is the case on line 4 of FIG. 6. This error is called the FAC target in FIG. 8. The error signal 138 is filtered by filter W (z) at 140, with an initial state of this filter, i.e. with an initial state if its filter memory, being the ACELP error 141 in the ACELP frame 122 on line 4 in FIG. 6. The output of filter W(z) then forms the input of a transform 142 in FIG. 6. The transform is exemplarily shown to be an MDCT. The transform coefficients output by the MDCT are then quantized and encoded in processing module 143. These encoded coefficients might form at least a part of the aforementioned FAC data 34. These encoded coefficients may be transmitted to the coding side. The output of process Q, namely the quantized MDCT coefficients, is then the input of an inverse transform such as an IMDCT 144 to form a time-domain signal which is then filtered by the inverse filter 1/W(z) at 145 which has zero-memory (zero initial state). Filtering through 1/W(z) is extended to past the length of the FAC target using zero-input for the samples that extend after the FAC target. The output of filter 1/W(z) is a FAC synthesis signal 146, which is a correction signal that may now be applied at the beginning of the TC frame 120 to compensate for the windowing and time-domain aliasing effect occurring there.

Now, the processing for the windowing and time-domain aliasing correction at the end of the TC frame 120 (before marker LPC2) is described. To this end, reference is made to FIG. 9.

Figure 9:
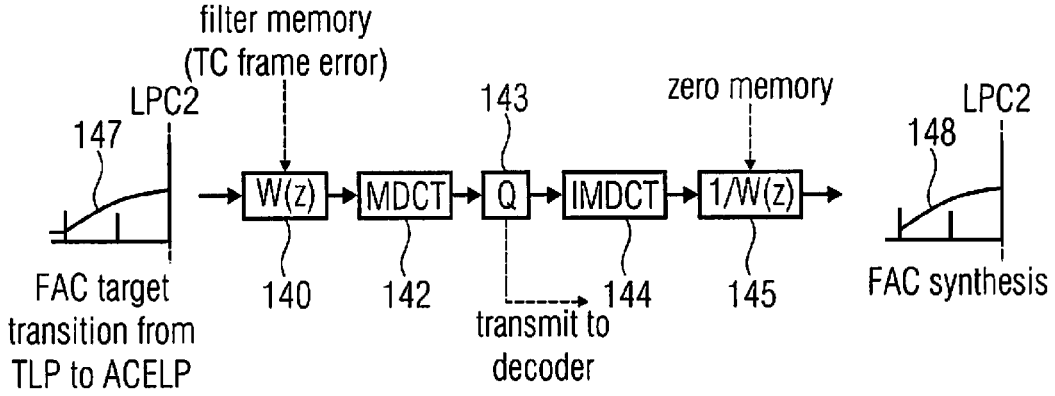

The error signal at the end of the TC frame 120 on line 4 in FIG. 6 is provided with reference sign 147 and represents the FAC target in FIG. 9. The FAC target 147 is subject to the same process sequence as FAC target 138 of FIG. 8 with the processing merely differing in the initial state of the weighting filter W(z) 140. The initial state of filter 140 in order to filter FAC target 147 is the error in the TC frame 120 on line 4 of FIG. 6, indicated by reference sign 148 in FIG. 6. Then, the further processing steps 142 to 145 are the same as in FIG. 8 which dealt with the processing of the FAC target at the beginning of the TC frame 120.

Figure 10:
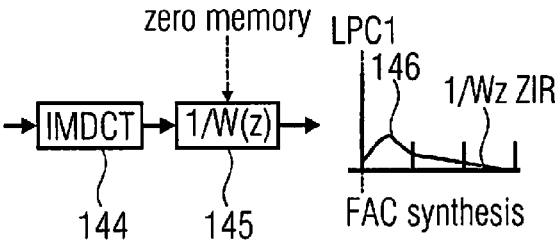
FIG. 10, 11 are block diagrams showing as to how the decoder handles the data stream in order to derive the FAC data of FIGS. 8 and 9 from the data stream.
Figure 11:
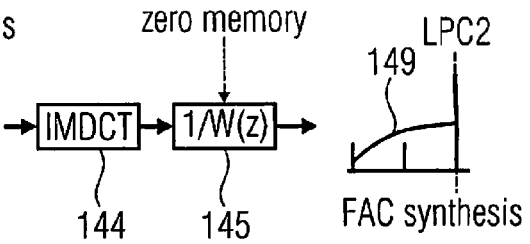

The processing in FIGS. 8 and 9 is performed completely from left to right when applied at the encoder to obtain the local FAC synthesis and to compute the resulting reconstruction in order to ascertain as to whether the change of the coding mode involved by choosing the TC coding mode of frame 120 is the optimum choice or not. At the decoder, the processing in FIGS. 8 and 9 is only applied from the middle to the right. That is, the encoded and quantized transform coefficients transmitted by processor Q 143 are decoded to form the input of the IMDCT. Look, for example to FIGS. 10 and 11. FIG. 10 equals the right hand side of FIG. 8 whereas FIG. 11 equals the right hand side of FIG. 9. Transition handler 60 of FIG. 3 may, in accordance with the specific embodiment outlined now, be implemented in accordance with FIGS. 10 and 11. That is, transition handler 60 may subject transform coefficient information within the FAC data 34 present within the current frame 14*b* to a re-transform in order to yield a first FAC synthesis signal 146 in case of transition from an ACELP time segment sub-part to an FD time segment or TCX sup-part, or a second FAC synthesis signal 149 when transitioning from an FD time segment or TCX sub-part of an time segment to an ACELP time segment sub-part.

Note again, the FAC data 34 may relate to such a transition occurring inside the current time segment in which case the existence of the FAC data 34 is derivable for parser 20 from solely from syntax portion 24, whereas parser 20 needs to, in case of the previous frame having got lost, exploit the syntax portion 26 in order to determine as to whether FAC data 34 exists for such transitions at the leading edge of the current time segment 16*b*.

Figure 12:
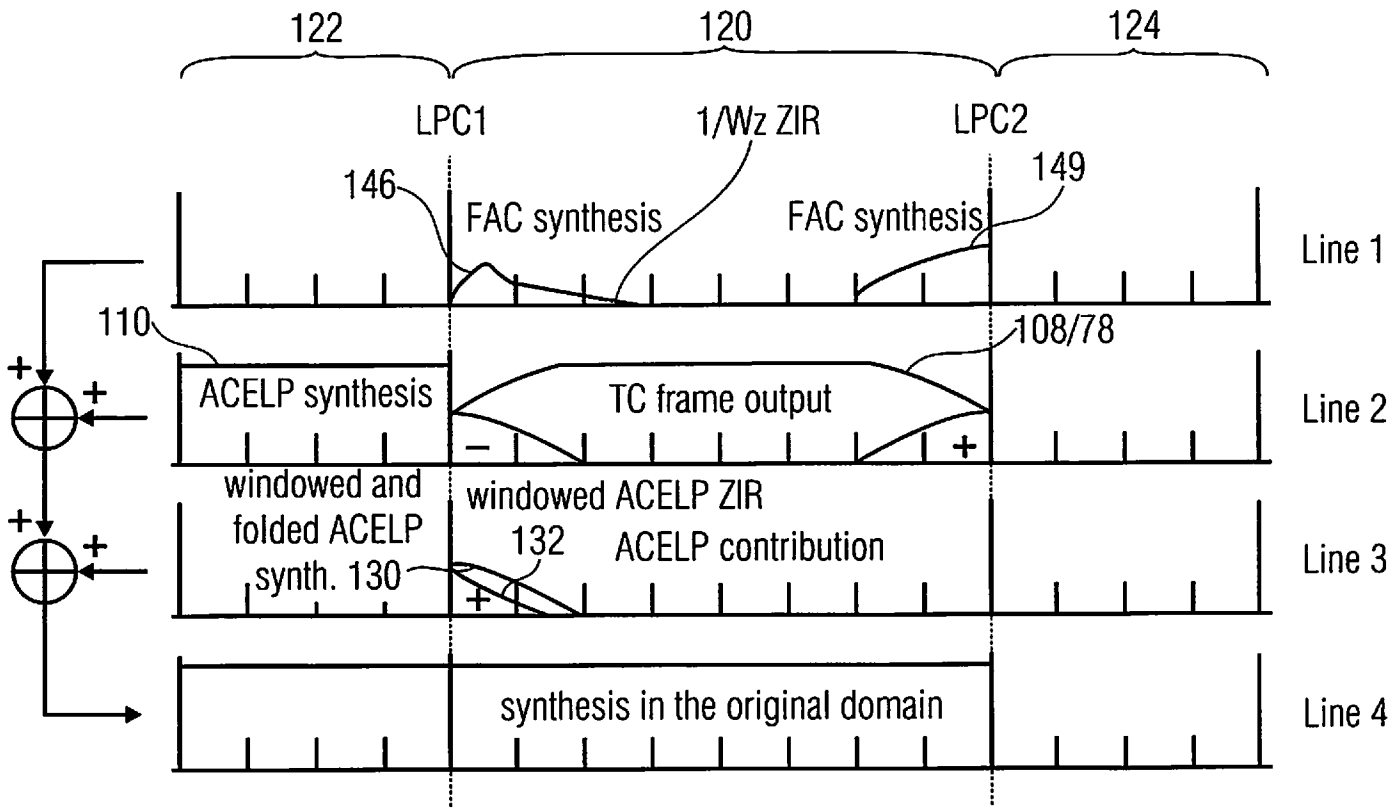
FIG. 12 is a schematic diagram of the FAC based reconstruction at the decoding side across from boundaries of frames of different coding mode.
Figure 13:
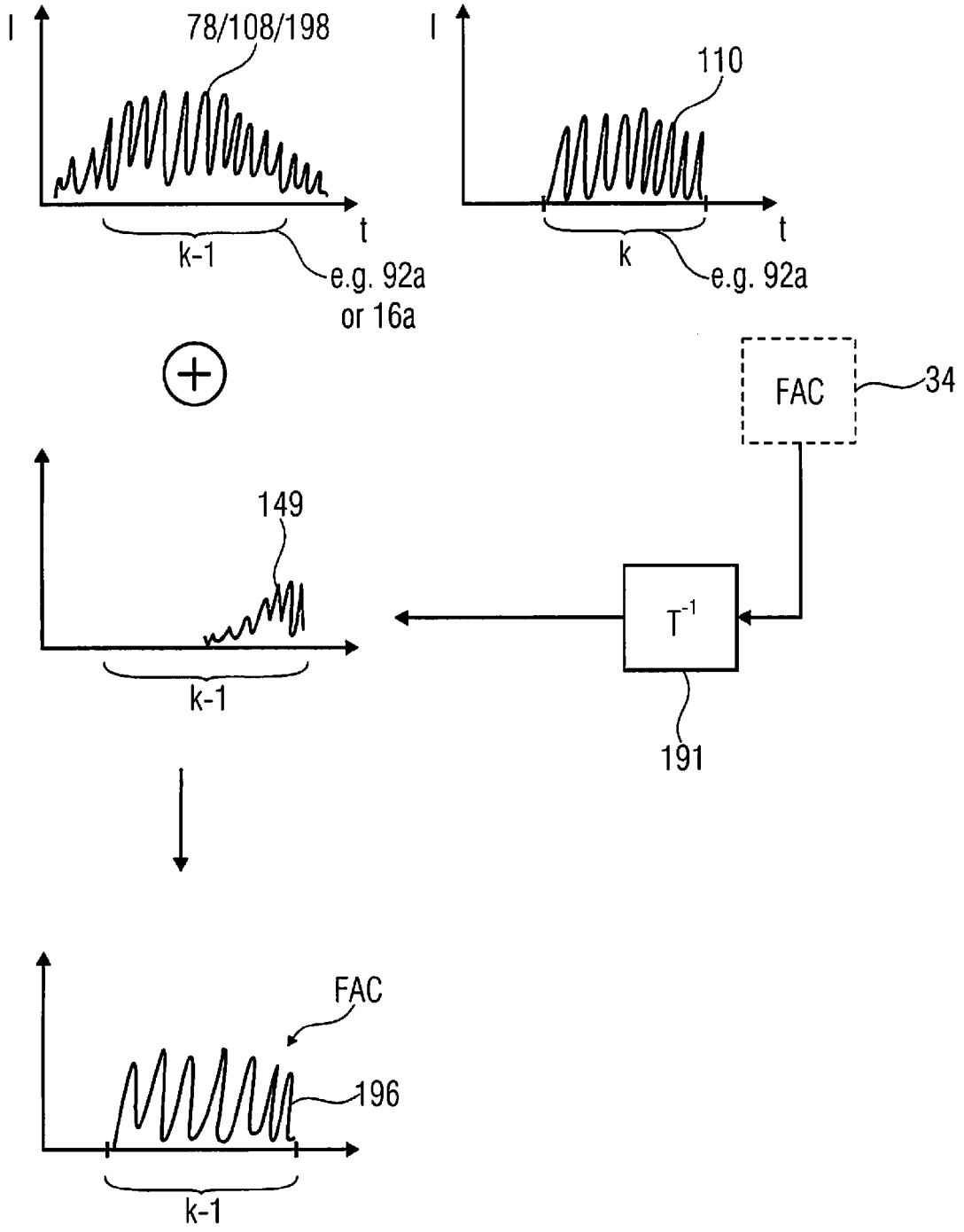
FIGS. 13, 14 are schematically the processing performed at the transition handler of FIG. 3 in order to perform the reconstruction of FIG. 12.
Figure 14:
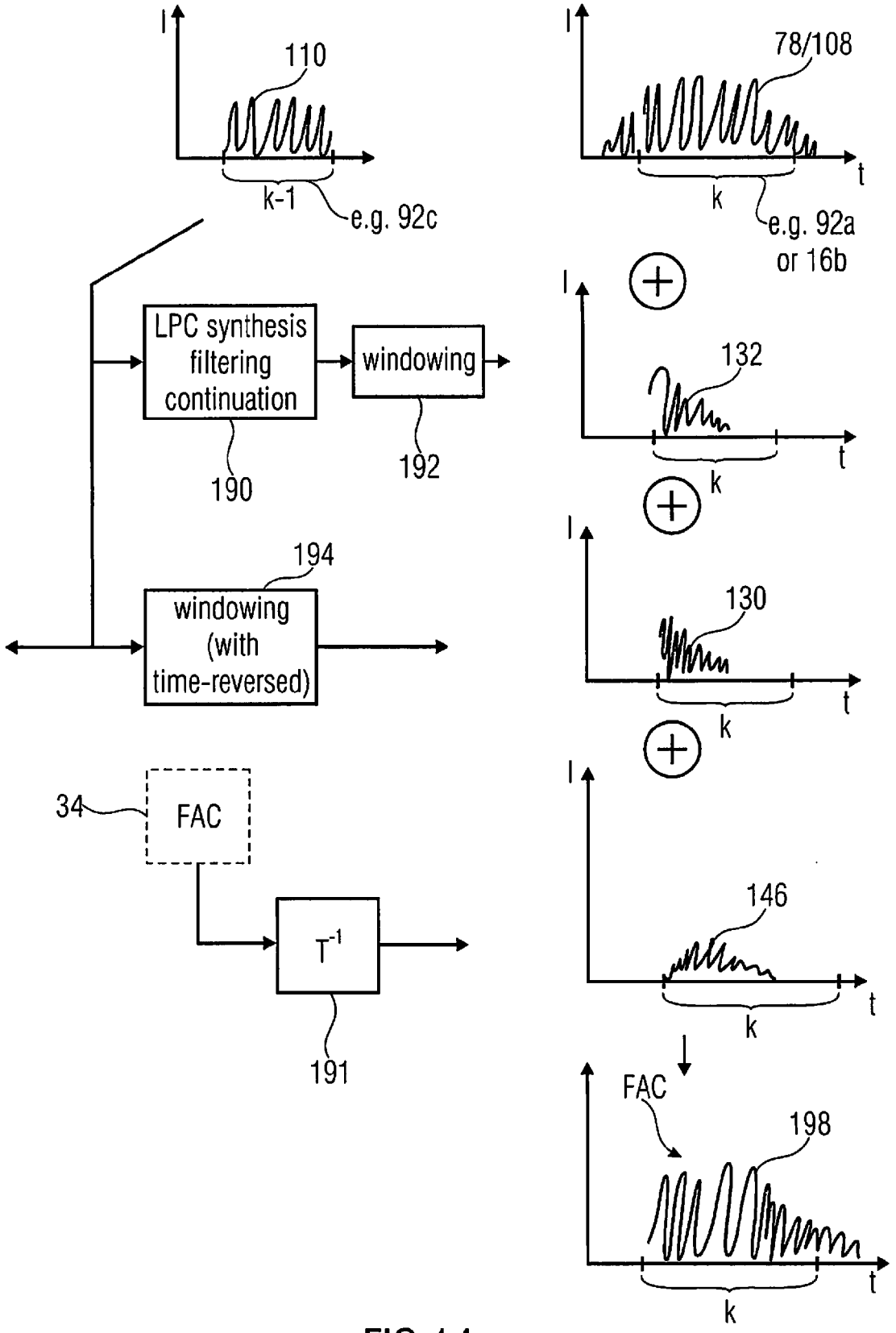

FIG. 12 shows how to the complete synthesis or reconstructed signal for the current frame 120 can be obtained by using the FAC synthesis signals in FIGS. 8 to 11 and applying the inverse steps of FIG. 6. Note again, that even the steps which are shown now in FIG. 12, are also performed by the encoder in order to ascertain as to whether the coding mode for the current frame leads to the best optimization in, for example, rate/distortion sense or the like. In FIG. 12, it is assumed that the ACELP frame 122 at the left of marker LPC1 is already synthesized or reconstructed such as by module 58 of FIG. 3, up to marker LPC1 thereby leading to the ACELP synthesis signal on line 2 of FIG. 12 with reference sign 110. Since a FAC correction is also used at the end of the TC frame, it is also assumed that the frame 124 after marker LPC2 will be an ACELP frame. Then, to produce a synthesis or reconstructed signal in the TC frame 120 between markers LPC1 and LPC2 in FIG. 12, the following steps are performed. These steps are also illustrated in FIGS. 13 and 14, with FIG. 13 illustrating the steps performed by transition handler 60 in order to cope with transitions from a TC coded segment or segment sub-part to an ACELP coded segment sub-part, whereas FIG. 14 describes the operation of transition handler for the reverse transitions.

1. One step is to decode the MDCT-encoded TC frame and position the thus obtained time-domain signal between markers LPC1 and LPC2 as shown in line 2 of FIG. 12. Decoding is performed by module 54 or module 56 and includes the inverse MDCT as an example for a TDAC re-transform so that the decoded TC frame contains windowing and time-domain aliasing effects. In other words, the segment or time segment sub-part currently to be decoded and indicated by index k in FIGS. 13 and 14, may be an ACELP coded time segment sub-part 92*a* as illustrated in FIG. 13 or a time segment 16*b* which is FD coded or a TCX coded sub-part 92*a* as illustrated in FIG. 14. In case of FIG. 13, the previously processed frame is thus a TC coded segment or time segment sub-part, and in case of FIG. 14, the previously processed time segment is ACELP coded sub-part. The reconstructions or synthesis signal as output by modules 54 to 58 partially suffer from the aliasing effects. This is also true for the signal segments 78/108.

2. Another step in the processing of the transition handler 60 is the generation of the FAC synthesis signal according to FIG. 10 in case of FIG. 14, and in accordance with FIG. 11 in case of FIG. 13. That is, transition handler 60 may perform a re-transform 191 onto transform coefficients within the FAC data 34, in order to obtain the FAC synthesis signals 146 and 149, respectively. The FAC synthesis signals 146 and 149 are positioned at the beginning and end of the TC coded segment which, in turn, suffers from the aliasing effects and is registered to the time segment 78/108. In case of FIG. 13, for example, transition handler 60 positions FAC synthesis signal 149 at the end of the TC coded frame k−1 as also shown in line 1 of FIG. 12. In case of FIG. 14, transition handler 60 positions the FAC synthesis signal 146 at the beginning of the TC coded frame k as is also shown in line 1 of FIG. 12. Note again that frame k is the frame currently to be decoded, and that frame k−1 is the previously decoded frame.

3. As far as the situation of FIG. 14 is concerned where the coding mode change occurs at the beginning of the current TC frame k, the windowed and folded (inverted) ACELP synthesis signal 130 from the ACELP frame k−1 preceding the TC frame k, and the windowed zero-input response, or ZIR, of the LPC1 synthesis filter, i.e. signal 132, are positioned so as to be registered to the re-transformed signal segment 78/108 suffering from aliasing. This contribution is shown in line 3 of FIG. 12. As shown in FIG. 14 and as already being described above, transition handler 60 obtains aliasing cancellation signal 132 by continuing the LPC synthesis filtering of the preceding CELP sub-frame beyond the leading boundary of the current time segment k and windowing the continuation of signal 110 within the current signal k with both steps being indicated with reference signs 190 and 192 in FIG. 14. In order to obtain aliasing cancellation signal 130, the transition handler 60 also windows in step 194 the reconstructed signal segment 110 of the preceding CELP frame and uses this windowed and time-reversed signal as the signal 130.

4. The contributions of lines 1, 2 and 3 of FIG. 12 and the contributions 78/108, 132, 130 and 146 in FIG. 14 and contributions 78/108, 149 and 196 in FIG. 13, are added by transition handler 60 in the registered positions explained above, to form the synthesis or reconstructed audio signal for the current frame k in the original domain as shown in line 4 of FIG. 12. Note that the processing of FIGS. 13 and 14 produces a synthesis or reconstructed signal 198 in a TC frame where time-domain aliasing and windowing effects are cancelled at the beginning and end of the frame, and where the potential discontinuity of the frame boundary around marker LPC1 has been smoothed and perceptually masked by the filter 1/W(z) in FIG. 12.

Thus, FIG. 13 pertains the current processing of the CELP coded frame k and leads to forward aliasing cancellation at the end of the preceding TC coded segment. As illustrated at 196, the finally reconstructed audio signal is aliasing less reconstructed across the boundary between segments k−1 and k. Processing of FIG. 14 leads to forward aliasing cancellation at the beginning of the current TC coded segment k as illustrated at reference sign 198 showing the reconstructed signal across the boundary between segments k and k−1. The remaining aliasing at the rear end of the current segment k is either cancelled by TDAC in case the following segment is a TC coded segment, or FAC according to FIG. 13 in case the subsequent segment is ACELP coded segment. FIG. 13 mentions this latter possibility by assigning reference sign 198 to signal segment of time segment k−1.

In the following, specific possibilities will be mentioned as to how the second syntax portion 26 may be implemented.

For example, in order to handle the occurrence of lost frames, the syntax portion 26 may be embodied as a 2-bit field prev_mode that signals within the current frame 14*b* explicitly the coding mode that was applied in the previous frame 14*a* according to the following table:

| prev_mode | | |
|---|---|---|
| ACELP | 0 | 0 |
| TCX | 0 | 1 |
| FD_long | 1 | 0 |
| FD_short | 1 | 1 |

With other words, this 2-bit field may be called prev_mode and may thus indicate a coding mode of the previous frame 14*a*. In case of the just-mentioned example, four different states are differentiated, namely:

1) The previous frame 14*a* is an LPD frame, the last sub-frame of which is an ACELP sub-frame;

2) the previous frame 14*a* is an LPD frame, the last sub-frame of which is a TCX coded sub-frame;

3) the previous frame is an FD frame using a long transform window and 4) the previous frame is an FD frame using short transform windows.

The possibility of potentially using different window lengths of FD coding mode has already been mentioned above with respect to the description of FIG. 3. Naturally, the syntax portion 26 may have merely three different states and the FD coding mode may merely be operated with a constant window length thereby summarizing the two last ones of the above-listed options 3 and 4.

In any case, based on the above-outlined 2-bit field, the parser 20 is able to decide as to whether FAC data for the transition between the current time segment and the previous time segment 16*a* is present within the current frame 14*b* or not. As will be outlined in more detail below, parser 20 and reconstructor 22 are even able to determine based on prev_mode as to whether the previous frame 14*a* has been an FD frame using a long window (FD_long) or as to whether the previous frame has been an FD frame using short windows (FD_short) and as to whether the current frame 14*b* (if the current frame is an LPD frame) succeeds an FD frame or an LPD frame which differentiation is needed according to the following embodiment in order to correctly parse the data stream and reconstruct the information signal, respectively.

Thus, in accordance with the just-mentioned possibility of using a 2-bit identifier as the syntax portion 26, each frame 14*a* to 14*c* would be provided with an additional 2-bit identifier in addition to the syntax portion 24 which defines the coding mode of the current frame to be a FD or LPD coding mode and the sub-framing structure in case of LPD coding mode.

For all of the above embodiments, it should be mentioned that other inter-frame dependencies should be avoided as well. For example, the decoder of FIG. 1 could be capable of SBR. In that case, a crossover frequency could be parsed by parser 20 from every frame 14*a* to 14*c* within the respective SBR extension data instead of parsing such a crossover frequency with an SBR header which could be transmitted within the data stream 12 less frequently. Other inter-frame dependencies could be removed in a similar sense.

It is worthwhile to note for all the above-described embodiments, that the parser 20 could be configured to buffer at least the currently decoded frame 14*b* within a buffer with passing all the frames 14*a* to 14*c* through this buffer in a FIFO (first in first out) manner. In buffering, parser 20 could perform the removal of frames from this buffer in units of frames 14*a* to 14*c*. That is, the filling and removal of the buffer of parser 20 could be performed in units of frames 14*a* to 14*c* so as to obey the constraints imposed by the maximally available buffer space which, for example, accommodates merely one, or more than one, frames of maximum size at a time.

An alternative signaling possibility for syntax portion 26 with reduced bit consumption will be described next. According to this alternative, a different construction structure of the syntax portion 26 is used. In the embodiment described before, the syntax portion 26 was a 2-bit field which is transmitted in every frame 14*a* to 14*c* of the encoded USAC data stream. Since for the FD part it is only important for the decoder to know whether it has to read FAC data from the bit stream in case the previous frame 14*a* was lost, these 2-bits can be divided into two 1-bit flags where one of them is signaled within every frame 14*a* to 14*c* as fac_data_present. This bit may be introduced in the single_channel_element and channel_pair_element structure accordingly as shown in the tables of FIGS. 15 and 16. FIGS. 15 and 16 may be seen as a high level structure definition of the syntax of the frames 14 in accordance with the present embodiment, where functions "function_name( . . . )" call subroutines, and bold written syntax element names indicate the reading of the respective syntax element from the data stream. In other words, the marked portions or hatched portions in FIGS. 15 and 16 show that each frame 14*a* to 14*c* is, in accordance with this embodiment, provided with a flag fac_data_present. Reference signs 199 show these portions.

The other 1-bit flag prev_frame_was_lpd is then only transmitted in the current frame if same was encoded using the LPD part of USAC, and signals whether the previous frame was encoded using the LPD path of the USAC as well. This is shown in the table of FIG. 17.

The table of FIG. 17 shows a part of the information 28 in FIG. 1 in case of the current fame 14*b* being an LPD frame. As shown at 200, each LPD frame is provided with a flag prev_frame_was_lpd. This information is used to parse the syntax of the current LPD frame. That the content and the position of the FAC data 34 in LPD frames depends on the transition at the leading end of the current LPD frame being a transition between TCX coding mode and CELP coding mode or a transition from FD coding mode to CELP coding mode is derivable from FIG. 18. In particular, if the currently decoded frame 14*b* is an LPD frame just preceded by an FD frame 14*a*, and fac_data_present signals that FAC data is present in the current LPD frame (because the leading sub-frame is an ACELP sub-frame) then FAC data is read at the end of the LPD frame syntax at 202 with the FAC data 34 including, in that case, a gain factor fac_gain as shown at 204 in FIG. 18. With this gain factor, the contribution 149 of FIG. 13 is gain-adjusted.

If, however, the current frame is an LPD frame with the preceding frame being also an LPD frame, i.e. if a transition between TCX and CELP sub-frames occurs between the current frame and the previous frame, FAC data is read at 206 without the gain adjustability option, i.e. without the FAC data 34 including the FAC gain syntax element fac_gain. Further, the position of the FAC data read at 206 differs from the position at which FAC data is read at 202 in case of the current frame being an LPD frame and the previous frame being an FD frame. While the position of reading 202 occurs at the end of the current LPD frame, the reading of the FAC data at 206 occurs before the reading of the sub-frame specific data, i.e. the ACELP or TCX data depending on the modes of the sub-frames of the sub-frames structure, at 208 and 210, respectively.

In the example of FIGS. 15 to 18, the LPC information 104 (FIG. 5) is read after the sub-frames specific data such as 90*a* and 90*b* (compare FIG. 5) at 212.

For completeness only, the syntax structure of the LPD frame according to FIG. 17 is further explained with regard to FAC data potentially additionally contained within the LPD frame in order to provide FAC information with regard to transitions between TCX and ACELP sub-frames in the inner of the current LPD coded time segment. In particular, in accordance with the embodiment of FIGS. 15 to 18, the LPD sub-frame structure is restricted to sub-divide the current LPD coded time segment merely in units of quarters with assigning these quarters to either TCX or ACELP. The exact LPD structure is defined by the syntax element lpd_mode read at 214. The first and the second and the third and the fourth quarter may form together a TCX sub-frame whereas ACELP frames are restricted to the length of a quarter only. A TCX sub-frame may also extend over the whole LPD encoded time segment in which case the number sub-frames is merely one. The while loop in FIG. 17 steps through the quarters of the currently LPD coded time segment and transmits, whenever the current quarter k is the beginning of a new sub-frame within the inner of the currently LPD coded time segment, FAC data at 216 provided the immediately preceding sub-frame of the currently beginning/decoded LPD frame is of the other mode, i.e. TCX mode if the current sub-frame is of ACELP mode and these versa.

For sake of completeness only, FIG. 19 shows a possible syntax structure of an FD frame in accordance with the embodiment of FIGS. 15 to 18. It can be seen that FAC data is read at the end of the FD frame with the decision as to whether FAC data 34 is present or not, merely involving the fac_data_present flag. Compared thereto, parsing of the fac_data 34 in case of LPD frames as shown in FIG. 17 necessitates, for a correct parsing, the knowledge of the flag prev_frame_was_lpd.

Thus, the 1-bit flag prev_frame_was_lpd is only transmitted if the current frame is encoded using the LPD part of USAC and signals whether the previous frame was encoded using the LPD path of the USAC codec (see Syntax of lpd_channel_stream( ) in FIG. 17)

Regarding the embodiment of FIGS. 15 to 19, it should be further noted, that a further syntax element could be transmitted at 220, i.e. in the case the current frame is an LPD frame and the previous frame is an FD frame (with a first frame of the current LPD frame being an ACELP frame) so that FAC data is to be read at 202 for addressing the transition from FD frame to ACELP sub-frame at the leading end of the current LPD frame. This additional syntax element read at 220 could indicate as to whether the previous FD frame 14*a* is of FD_long or FD_short. Depending on this syntax element, the FAC data 202 could be influenced. For example, the length of the synthesis signal 149 could be influenced depending on the length of the window used for transforming the previous LPD frame. Summarizing the embodiment of FIGS. 15 and 19 and transferring features mentioned therein onto the embodiment described with respect to FIGS. 1 to 14, the following could be applied onto the latter embodiments either individually or in combination:

1) The FAC data 34 mentioned in the previous figures was meant to primarily note the FAC data present in the current frame 14*b* in order to enable forward aliasing cancellation occurring at the transition between the previous frame 14*a* and the current frame 14*b*, i.e. between the corresponding time segments 16*a* and 16*b*. However, further FAC data may be present. This additional FAC data, however, deals with the transitions between TCX coded sub-frames and CELP coded sub-frames positioned internally to the current frame 14*b* in case the same is of the LPD mode. The presence or absence of this additional FAC data is independent from the syntax portion 26. In FIG. 17, this additional FAC data was read at 216. The presence or existence thereof merely depends on lpd_mode read at 214. The latter syntax element, in turn, is part of the syntax portion 24 revealing the coding mode of the current frame. lpd_mode along with core_mode read at 230 and 232 shown in FIGS. 15 and 16 corresponds to syntax portion 24.

2) Further, the syntax portion 26 may be composed of more than one syntax element as described above. The flag FAC_data_present indicates as to whether fac_data for the boundary between the previous frame and the current frame is present or not. This flag is present at an LPD frame as well as FD frames. A further flag, in the above embodiment called prev_frame_was_lpd, is transmitted in LPD frames only in order to denote as to whether the previous frame 14*a* was of the LPD mode or not. In other words, this second flag included in the syntax portion 26 indicates as to whether the previous fame 14*a* was an FD frame. The parser 20 expects and reads this flag merely in case of the current frame being an LPD frame. In FIG. 17, this flag is read at 200. Depending on this flag, parser 20 may expect the FAC data to comprise, and thus read from the current frame, a gain value fac_gain. The gain value is used by the reconstructor to set a gain of the FAC synthesis signal for FAC at the transition between the current and the previous time segments. In the embodiment of FIGS. 15 to 19, this syntax element is read at 204 with the dependency on the second flag being clear from comparing the conditions leading to reading 206 and 202, respectively. Alternatively or additionally, prev_frame_was_lpd may control a position where parser 20 expects and reads the FAC data. In the embodiment of FIGS. 15 to 19 these positions were 206 or 202. Further, the second syntax portion 26 may further comprise a further flag in case of the current frame being an LPD frame with the leading sub-frame of which being an ACELP frame and a previous frame being an FD frame in order indicate as to whether the previous FD frame is encoded using a long transform window or a short transform window. The latter flag could be read at 220 in case of the previous embodiment of FIGS. 15 to 19. The knowledge about this FD transform length may be used in order to determine the length of the FAC synthesis signals and the size of the FAC data 34, respectively. By this measure, the FAC data may be adapted in size to the overlap length of the window of the previous FD frame so that a better compromise between coding quality and coding rate may be achieved.

3) By dividing-up the second syntax portion 26 into the just-mentioned three flags, it is possible to transmit merely one flag or bit to signal the second syntax portion 26 in case of the current frame being an FD frame, merely two flags or bits in case of the current frame being an LPD frame and the previous frame being an LPD frame, too. Merely in case of a transition from an FD frame to a current LPD frame, a third flag has to be transmitted in the current frame. Alternatively, as stated above, the second syntax portion 26 may be a 2-bit indicator transmitted for every frame and indicating the mode the frame preceding this frame to the extent needed for the parser to decide as to whether FAC data 34 has to be read from the current frame or not, and if so, from where and how long the FAC synthesis signal is. That is, the specific embodiment of FIGS. 15 to 19 could be easily transferred to the embodiment of using the above 2-bit identifier for implementing the second syntax portion 26. Instead of FAC_data_present in FIGS. 15 and 16, the 2-bit identifier would be transmitted. Flags at 200 and 220 would not have to be transmitted. Instead, the content of fac_data_present in the if-clause leading to 206 and 218, could be derived by the parser 20 from the 2-bit identifier. The following table could be accessed at the decoder to exploit the 2-bit indicator.

| prev_mode | core_mode of current frame (superframe) | first_lpd_flag |
|---|---|---|
| ACELP | 1 | 0 |
| TCX | 1 | 0 |
| FD_long | 1 | 1 |
| FD_short | 1 | 1 |

A syntax portion 26 could also merely have three different possible values in case FD frames will use only one possible length.

A slightly differing, but very similar syntax structure to that described above with respect to 15 to 19 is shown in FIGS. 20 to 22 using the same reference signs as used with respect to FIGS. 15 to 19, so that reference is made to that embodiment for explanation of the embodiment of FIGS. 20 to 22.

With regard to the embodiments described with respect to FIG. 3 et seq., it is noted that any transform coding scheme with aliasing propriety may be used in connection with the TCX frames, other than MDCT. Furthermore, a transform coding scheme such as FFT could also be used, then without aliasing in the LPD mode, i.e. without FAC for subframe transitions within LPD frames, and thus, without the need for transmitting FAC data for sub-frame boundaries in between LPD boundaries. FAC data would then merely be included for every transition from FD to LPD and vice versa.

With regard to the embodiments described with respect to FIG. 1 et seq., it is noted that same were directed to the case where the additional syntax portion 26 was set in line, i.e. uniquely depending on a comparison between the coding mode of the current frame and the coding mode of the previous frame as defined in the first syntax portion of that previous frame, so that in all of the above embodiments the decoder or parser was able to uniquely anticipate the content of the second syntax portion of the current frame by use of, or comparing, the first syntax portion of these frames, namely the previous and the current frame. That is, in case of no frame loss, it was possible for the decoder or parser to derive from the transitions between frames whether FAC data is present or not in the current frame. If a frame is lost, the second syntax portion such as the flag fac_data_present bit explicitly gives that information. However, in accordance with another embodiment, the encoder could exploit this explicit signalisation possibility offered by the second syntax portion 26 so as to apply a converse coding according which the syntax portion 26 is adaptively, i.e. with the decision there upon being performed on a frame by frame basis, for example—set such that although the transition between the current frame and the previous frame is of the type which usually comes along with FAC data (such as FD/TCX, i.e. any TC coding mode, to ACELP, i.e. any time domain coding mode, or vice versa) the current frame's syntax portion indicates the absence of FAC. The decoder could then be implemented to strictly act according to the syntax portion 26, thereby effectively disabling, or suppressing, the FAC data transmission at the encoder which signals this suppression merely by setting, for example, fac_data_present=0. The scenario where this might be a favourable option is when coding at very low bit rates where the additional FAC data might cost too much bits whereas the resulting aliasing artefact might be tolerable compared to the overall sound quality.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitory.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. Decoder apparatus for decoding a data stream comprising a sequence of frames comprising a plurality of respective frames into which time segments of an information signal are coded, respectively, comprising a parser configured to parse the data stream, wherein the parser is configured to, in parsing the data stream, read a first syntax portion and a second syntax portion from a current frame; and a reconstructor configured to reconstruct a current time segment of the information signal associated with the current frame based on information acquired from the current frame by the parsing, using, depending on a first selection, a Time-Domain Aliasing Cancellation transform decoding mode or a time-domain decoding mode, the first selection depending on the first syntax portion, wherein the parser is configured to, in parsing the data stream, perform a first action of expecting the current frame to comprise, and thus reading forward aliasing cancellation data from the current frame or a second action of not-expecting the current frame to comprise, and thus not reading forward aliasing cancellation data from the current frame, wherein the parser is configured to perform a second selection selecting which of the first action and the second action is performed, depending on the second syntax portion, wherein the reconstructor is configured to perform forward aliasing cancellation at a boundary between the current time segment and a previous time segment of a previous frame using the forward aliasing cancellation data, wherein at least one of the parser and the reconstructor is implemented on a microprocessor, a programmable logic device or an electronic circuit.

2. Decoder apparatus according to claim 1, wherein the first and second syntax portions are comprised by each frame, wherein the first syntax portion associates the respective frame from which the first syntax portion has been read, with a first frame type or a second frame type and, if the respective frame is of the second frame type, associates sub frames comprising a plurality of respective sub frames of a division of the respective frame, composed of a number of sub frames, with a respective one of a first sub frame type and a second sub frame type, wherein the reconstructor is configured to, if the first syntax portion associates the respective frame with the first frame type, use frequency domain decoding as a first version of the time-domain aliasing cancellation transform decoding mode to reconstruct the time segment associated with the respective frame, and, if the first syntax portion associates the respective frame with the second frame type, use, for each sub frame of the respective frame, transform coded excitation linear prediction decoding as a second version of the time-domain aliasing cancellation transform decoding mode to reconstruct a sub portion of the time segment of the respective frame, which is associated with the respective sub frame, if the first syntax portion associates the respective sub frame of the respective frame with the first sub frame type, and codebook excitation linear prediction decoding as the time-domain decoding mode to reconstruct a sub portion of the time segment of the respective frame, which is associated with the respective sub frame, if the first syntax portion associates the respective sub frame with the second sub frame type.

3. Decoder apparatus according to claim 2, wherein the reconstructor is configured to per frame of the first frame type, perform a spectral varying de-quantization of transform coefficient information within the respective frame of the first frame type based on scale factor information within the respective frame of the first frame type, and a re-transform on the de-quantized transform coefficient information to acquire a re-transformed signal segment extending, in time, over and beyond the time segment associated with the respective frame of the first frame type, and per frame of the second frame type, per sub frame of the first sub frame type of the respective frame of the second frame type, derive a spectral weighting filter from LPC information within the respective frame of the second frame type, spectrally weighting transform coefficient information within the respective sub frame of the first sub frame type using the spectral weighting filter, and re-transform the spectrally weighted transform coefficient information to acquire a re-transformed signal segment extending, in time, over and beyond the sub portion of the time segment associated with the respective sub frame of the first sub frame type, and, per sub frame of the second sub frame type of the respective frame of the second frame type, derive an excitation signal from excitation update information within the respective sub frame of the second sub frame type and perform LPC synthesis filtering on the excitation signal using the LPC information within the respective frame of the second frame type in order to acquire an LP synthesized signal segment for the sub portion of the time segment associated with the respective sub frame of the second sub frame type, and perform time-domain aliasing cancellation within temporarily overlapping window portions at boundaries between time segments of immediately consecutive ones of frames of the first frame type and sub portions of time segments, which are associated with sub frames of the first sub frame type, to reconstruct the information signal thereacross, and if the previous frame is of the first frame type or of the second frame type with the last sub frame thereof being of the first sub frame type, and the current frame is of the second frame type with the first sub frame thereof being of the second sub frame type, derive a first forward aliasing cancellation synthesis signal from the forward aliasing cancellation data and add the first forward aliasing cancellation synthesis signal to the re-transformed signal segment within the previous time segment to reconstruct the information signal across the boundary between the previous and current frames, and if the previous frame is of the second frame type with the first sub frame thereof being of the second sub frame type, and the current frame is of the first frame type or of the second frame type with the last sub frame thereof being of the first sub frame type, derive a second forward aliasing cancellation synthesis signal from the forward aliasing cancellation data and add the second forward aliasing cancellation synthesis signal to the re-transformed signal segment within the current time segment to reconstruct the information signal across the boundary between the previous and current time segments.

4. Decoder apparatus according to claim 3, wherein the reconstructor is configured to derive the first forward aliasing cancellation synthesis signal from the forward aliasing cancellation data by performing a re-transform on transform coefficient information comprised by the forward aliasing cancellation data or derive the second forward aliasing cancellation synthesis signal from the forward aliasing cancellation data by performing the re-transform on transform coefficient information comprised by the forward aliasing cancellation data.

5. Decoder apparatus according to claim 3, wherein the second syntax portion comprises a first flag signaling as to whether forward aliasing cancellation data is present or not in the respective frame, and the parser is configured to perform the second selection depending on the first flag, and wherein the second syntax portion further comprises a second flag merely within frames of the second frame type, the second flag signaling as to whether the previous frame is of the first frame type or of the second frame type with the last sub frame thereof being of the first sub frame type.

6. Decoder apparatus according to claim 5, wherein the parser is configured to perform the reading of the forward aliasing cancellation data from the current frame, if the current frame is of the second frame type, depending on the second flag in that a forward aliasing cancellation gain is parsed from the forward aliasing cancellation data in case of the previous frame being of the first frame type, and not if the previous frame being of the second frame type with the last sub frame thereof being of the first sub frame type, wherein the reconstructor is configured to perform the forward aliasing cancellation at an intensity which depends on the forward aliasing cancellation gain in case of the previous frame being of the first frame type.

7. Decoder apparatus according to claim 6, wherein the second syntax portion further comprises a third flag signaling as to whether the previous frame involves a long transform window or short transform windows, merely within frames of the second frame type if the second flag signals that the previous frame is of the first frame type, wherein the parser is configured to perform the reading of the forward aliasing cancellation data from the current frame depending on the third flag such that an amount of forward aliasing cancellation data is greater if the previous frame involves the long transform window, and is lower if the previous frame involves the short transform windows.

8. Decoder apparatus according to claim 3, wherein the reconstructor is configured to, if the previous frame is of the second frame type with the last sub frame thereof being of the second sub frame type and the current frame is of the first frame type or the second frame type with the last sub frame thereof being of the first sub frame type, perform a windowing on the LP synthesis signal segment of the last sub frame of the previous frame to acquire a first aliasing cancellation signal segment and add the first aliasing cancellation signal segment to the re-transformed signal segment within the current time segment.

9. Decoder apparatus according to claim 3, wherein the reconstructor is configured to, if the previous frame is of the second frame type with the last sub frame thereof being of the second sub frame type and the current frame is of the first frame type or the second frame type with a first sub frame thereof being of the first sub frame type, continue the LPC synthesis filtering performed on the excitation signal from the previous frame into the current frame, window a thus derived continuation of the LP synthesis signal segment of the previous frame within the current frame to acquire a second aliasing cancellation signal segment and add the second aliasing cancellation signal segment to the re-transformed signal segment within the current time segment.

10. Decoder apparatus according to claim 1, wherein the second syntax portion comprises a set of possible values each of which is uniquely associated with one of a set of possibilities comprising the previous frame being of the first frame type, the previous frame being of the second frame type with the last sub frame thereof being of the first sub frame type, and the previous frame being of the second frame type with the last sub frame thereof being of the second sub frame type, and the parser is configured to perform the second selection based on a comparison between the second syntax portion of the current frame and the first syntax portion of the previous frame.

11. Decoder apparatus according to claim 10, wherein the parser is configured to perform the reading of the forward aliasing cancellation data from the current frame, if the current frame is of the second frame type, depending on the previous frame being of the second frame type with the last sub frame thereof being of the first sub frame type or the previous frame being of the first frame type in that a forward aliasing cancellation gain is parsed from the forward aliasing cancellation data in case of the previous frame being of the first frame type, and not if the previous frame being of the second frame type with the last sub frame thereof being of the first sub frame type, wherein the reconstructor is configured to perform the forward aliasing cancellation at an intensity which depends on the forward aliasing cancellation gain in case of the previous frame being of the first frame type.

12. Decoder apparatus according to claim 11, wherein the parser is configured to read, if the current frame is of the first frame type, the forward aliasing cancellation gain from the forward aliasing cancellation data wherein the reconstructor is configured to perform the forward aliasing cancellation at an intensity which depends on the forward aliasing cancellation gain.

13. Decoder apparatus according to claim 1, wherein the second syntax portion comprises a set of possible values each of which is uniquely associated with one of a set of possibilities comprising the previous frame being of the first frame type with involving a long transform window, the previous frame being of the first frame type with involving short transform windows, the previous frame being of the second frame type with the last sub frame thereof being of the first sub frame type, and the previous frame being of the second frame type with the last sub frame thereof being of the second sub frame type, and the parser is configured to perform the second selection based on a comparison between the second syntax portion of the current frame and the first syntax portion of the previous frame, and perform the reading of the forward aliasing cancellation data from the current frame, if the previous frame is of the first frame type, depending on the previous frame involving the long transform window or short transform windows such that an amount of forward aliasing cancellation data is greater if the previous frame involves the long transform window, and is lower if the previous frame involves the short transform windows.

14. Decoder apparatus according to claim 1, wherein the parser is configured to, in parsing the data stream, perform the second selection depending on the second syntax portion and independent from as to whether the current frame and the previous frame are decoded using equal or different ones of the Time-Domain Aliasing Cancellation transform decoding mode and the time-domain decoding mode.

15. Encoder apparatus for encoding an information signal into a data stream such that the data stream comprises a sequence of frames into which time segments of the information signal are coded, respectively, comprising a constructor configured to code a current time segment of the information signal into information of the current frame using, depending on a first selection, a Time-Domain Aliasing Cancellation transform coding mode or a time-domain coding mode; and an inserter configured to insert the information into the current frame along with a first syntax portion and a second syntax portion, wherein the first syntax portion signals the first selection, wherein the constructor and inserter are configured to determine forward aliasing cancellation data for forward aliasing cancellation at a boundary between the current time segment and a previous time segment of a previous frame and insert the forward aliasing cancellation data into the current frame in case the current frame and the previous frame are encoded using different ones of the Time-Domain Aliasing Cancellation transform coding mode and the time-domain coding mode, and refraining from inserting any forward aliasing cancellation data into the current frame in case the current frame and the previous frame are encoded using equal ones of the Time-Domain Aliasing Cancellation transform coding mode and the time-domain coding mode, wherein the second syntax portion is set depending on as to whether the current frame and the previous frame are encoded using equal or different ones of the Time-Domain Aliasing Cancellation transform coding mode and the time-domain coding mode, wherein at least one of the constructor and the inserter is implemented on a microprocessor, a programmable logic device or an electronic circuit.

16. Encoder apparatus according to claim 15, wherein the encoder apparatus is configured to, if the current frame and the previous frame are encoded using equal ones of the Time-Domain Aliasing Cancellation transform coding mode and the time-domain coding mode, set the second syntax portion to a first state signalling the absence of the forward aliasing cancellation data in the current frame, and, if the current frame and the previous frame are encoded using different ones of the Time-Domain Aliasing Cancellation transform coding mode and the time-domain coding mode, decide in a rate/distortion optimization sense, so as to refrain from inserting the forward aliasing cancellation data into the current frame although the current frame and the previous frame are encoded using different ones of the time-domain aliasing cancellation transform coding mode and the time-domain coding mode, with setting the second syntax portion such that the second syntax portion signals the absence of the forward aliasing cancellation data in the current frame, or inserting the forward aliasing cancellation data into the current frame with setting the second syntax portion such that the second syntax portion signals the insertion of the forward aliasing cancellation data into the current frame.

17. Method for decoding a data stream comprising a sequence of frames into which time segments of an information signal are coded, respectively, comprising parsing the data stream, wherein parsing the data stream comprises reading a first syntax portion and a second syntax portion from a current frame; and reconstructing a current time segment of the information signal associated with the current frame based on information acquired from the current frame by the parsing, using, depending on a first selection, a Time-Domain Aliasing Cancellation transform decoding mode or a time-domain decoding mode, the first selection depending on the first syntax portion, wherein, in parsing the data stream, a first action of expecting the current frame to comprise, and thus reading forward aliasing cancellation data from the current frame or a second action of not-expecting the current frame to comprise, and thus not reading forward aliasing cancellation data from the current frame is performed, wherein a second selection as to which the first and second action is performed, is performed depending on the second syntax portion, wherein the reconstructing comprises performing forward aliasing cancellation at a boundary between the current time segment and a previous time segment of a previous frame using the forward aliasing cancellation data, wherein at least one of the parsing and the reconstructing is performed using a microprocessor, a programmable logic device or an electronic circuit.

18. Method for encoding an information signal into data stream such that the data stream comprises a sequence of frames into which time segments of the information signal are coded, respectively, comprising coding a current time segment of the information signal into information of the current frame using, depending on a first selection, a Time-Domain Aliasing Cancellation transform encoding mode or a time-domain encoding mode; and inserting the information into the current frame along with a first syntax portion and a second syntax portion, wherein the first syntax portion signals the first selection, determining forward aliasing cancellation data for forward aliasing cancellation at a boundary between the current time segment and a previous time segment of a previous frame and inserting the forward aliasing cancellation data into the current frame in case the current frame and the previous frame are encoded using different ones of the Time-Domain Aliasing Cancellation transform encoding mode and the time-domain encoding mode, and refraining from inserting any forward aliasing cancellation data into the current frame in case the current frame and the previous frame are encoded using equal ones of the Time-Domain Aliasing Cancellation transform encoding mode and the time-domain encoding mode, wherein the second syntax portion is set depending on as to whether the current frame and the previous frame are encoded using equal or different ones of the Time-Domain Aliasing Cancellation transform encoding mode and the time-domain encoding mode, wherein at least one of the coding and the inserting is performed using a microprocessor, a programmable logic device or an electronic circuit.

19. A non-transitory computer-readable medium having stored thereon a computer program comprising a program code for performing, when running on a computer, a method for decoding a data stream comprising a sequence of frames into which time segments of an information signal are coded, respectively, comprising parsing the data stream, wherein parsing the data stream comprises reading a first syntax portion and a second syntax portion from a current frame; and reconstructing a current time segment of the information signal associated with the current frame based on information acquired from the current frame by the parsing, using, depending on a first selection, a Time-Domain Aliasing Cancellation transform decoding mode or a time-domain decoding mode, the first selection depending on the first syntax portion, wherein, in parsing the data stream, a first action of expecting the current frame to comprise, and thus reading forward aliasing cancellation data from the current frame and a second action of not-expecting the current frame to comprise, and thus not reading forward aliasing cancellation data from the current frame is performed, wherein a second selection as to which of the first and second action is performed, is performed depending on the second syntax portion, wherein the reconstructing comprises performing forward aliasing cancellation at a boundary between the current time segment and a previous time segment of a previous frame using the forward aliasing cancellation data.

20. A non-transitory computer-readable medium having stored thereon a computer program comprising a program code for performing, when running on a computer, a method for encoding an information signal into a data stream such that the data stream comprises a sequence of frames into which time segments of the information signal are coded, respectively, comprising coding a current time segment of the information signal into information of a current frame using, depending on a first selection, a Time-Domain Aliasing Cancellation transform encoding mode or a time-domain encoding mode; and inserting the information into the current frame along with a first syntax portion and a second syntax portion, wherein the first syntax portion signals the first selection, determining forward aliasing cancellation data for forward aliasing cancellation at a boundary between the current time segment and a previous time segment of a previous frame and inserting the forward aliasing cancellation data into the current frame in case the current frame and the previous frame are encoded using different ones of the Time-Domain Aliasing Cancellation transform encoding mode and the time-domain encoding mode, and refraining from inserting any forward aliasing cancellation data into the current frame in case the current frame and the previous frame are encoded using equal ones of the Time-Domain Aliasing Cancellation transform encoding mode and the time-domain encoding mode, wherein the second syntax portion is set depending on as to whether the current frame and the previous frame are encoded using equal or different ones of the Time-Domain Aliasing Cancellation transform encoding mode and the time-domain encoding mode.

* * * * *